US010676261B2

(12) United States Patent
Berge

(10) Patent No.: US 10,676,261 B2
(45) Date of Patent: Jun. 9, 2020

(54) CLOSURE ASSEMBLY

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 222 days.

(21) Appl. No.: 15/698,348

(22) Filed: Sep. 7, 2017

(65) Prior Publication Data

US 2019/0071224 A1 Mar. 7, 2019

(51) Int. Cl.

| | |
|---|---|
| ***B65D 51/22*** | (2006.01) |
| ***B65D 5/74*** | (2006.01) |
| *B65D 41/04* | (2006.01) |
| *B65D 47/08* | (2006.01) |

(52) U.S. Cl.

CPC ..... *B65D 51/222* (2013.01); *B65D 5/748* (2013.01); *B65D 41/0414* (2013.01); *B65D 47/0809* (2013.01); *B65D 2101/0015* (2013.01); *B65D 2101/0023* (2013.01); *B65D 2251/0093* (2013.01); *B65D 2251/023* (2013.01)

(58) Field of Classification Search

CPC ..... B65D 51/222; B65D 2251/0093; B65D 2101/0015; B65D 5/748; B65D 2251/023; B65D 2101/0023; B65D 47/0809; B65D 41/0414

See application file for complete search history.

(56) References Cited

U.S. PATENT DOCUMENTS

| | | | |
|---|---|---|---|
| 5,141,133 | A | 8/1992 | Ninomiya et al. |
| 6,089,391 | A | 7/2000 | Abelbeck et al. |
| 6,098,795 | A | 8/2000 | Mollstam et al. |
| 6,223,924 | B1 | 5/2001 | Ek et al. |
| 6,398,075 | B1 | 6/2002 | Laciacera et al. |
| 6,571,994 | B1 | 6/2003 | Adams et al. |
| 6,702,161 | B2 | 3/2004 | Adams et al. |
| 6,820,764 | B2 | 11/2004 | Miani et al. |
| 6,851,576 | B2 | 2/2005 | Dubach |
| 7,036,683 | B2 | 5/2006 | Dubach |
| 7,178,683 | B2 | 2/2007 | Birkmayer et al. |
| 7,207,465 | B2 | 4/2007 | Weist et al. |
| 7,261,226 | B2 | 8/2007 | Adams et al. |

(Continued)

FOREIGN PATENT DOCUMENTS

| | | |
|---|---|---|
| EP | 1007419 | 6/2000 |
| EP | 1084060 | 3/2001 |

(Continued)

*Primary Examiner* — James N Smalley

(74) *Attorney, Agent, or Firm* — Reinhart Boerner Van Deuren s.c.

(57) ABSTRACT

A closure including a base, a cutter and a cap is described which is configured to be attached to a container. Upon initial removal of the cap from the base, the cutter is configured to move downwards relative to the base so as to create an opening through the container. The portion of the container through which the cutter creates an opening may be formed of a film that is configured to be easily pierceable by the cutter. Methods of molding the closure components may include co-molding the cutter and base an in integral unit so as to facilitate and expedite assembly of the base, cutter and cap components to form the closure.

21 Claims, 28 Drawing Sheets

(56) References Cited

U.S. PATENT DOCUMENTS

| | | | |
|---|---|---|---|
| 7,337,921 | B2 | 3/2008 | Ma |
| 7,458,486 | B2 | 12/2008 | Weist et al. |
| 7,484,641 | B2 | 2/2009 | Casale et al. |
| 7,540,405 | B2 | 6/2009 | Sase et al. |
| 7,584,842 | B2 | 9/2009 | Neumeyer et al. |
| 7,757,892 | B2 | 7/2010 | Berman |
| 7,823,723 | B2 | 11/2010 | Anthony et al. |
| 7,841,484 | B2 | 11/2010 | Kaneko et al. |
| 7,886,922 | B2 | 2/2011 | Seelhofer |
| 7,934,637 | B2 | 5/2011 | Kaneko |
| 7,959,032 | B2 | 6/2011 | Bolli |
| 7,997,436 | B2 | 8/2011 | Bolli |
| 8,016,159 | B2 | 9/2011 | Ma |
| 8,020,729 | B2 | 9/2011 | Dubach |
| 8,157,115 | B2 | 4/2012 | Rho |
| 8,276,748 | B2 | 10/2012 | Nyambi et al. |
| 8,297,456 | B1 | 10/2012 | Anderson |
| 8,372,328 | B2 | 2/2013 | Dubach |
| 8,459,478 | B2 | 6/2013 | Alther et al. |
| 8,505,760 | B2 | 8/2013 | Ott |
| 8,646,634 | B2 | 2/2014 | Essebaggers et al. |
| 8,672,167 | B2 | 3/2014 | Leuenberger et al. |
| 8,695,833 | B2 | 4/2014 | Barron |
| 8,695,844 | B1 | 4/2014 | Molayem |
| 8,701,906 | B1 | 4/2014 | Anderson |
| 8,714,380 | B2 | 5/2014 | Casale et al. |
| 8,746,476 | B1 | 6/2014 | Clause et al. |
| 8,820,554 | B2 | 9/2014 | Zheng |
| 8,839,974 | B2 | 9/2014 | Brandenburger et al. |
| 9,004,305 | B2 | 4/2015 | Barron |
| 9,016,505 | B2 | 4/2015 | Canegallo |
| 9,051,099 | B2 | 6/2015 | Salinas |
| 9,067,714 | B2 | 6/2015 | Barron |
| 9,073,280 | B2 | 7/2015 | Wolters et al. |
| 9,079,181 | B2 | 7/2015 | Curry et al. |
| 9,132,950 | B1 | 9/2015 | Anderson et al. |
| 9,145,239 | B2 | 9/2015 | Wohlgenannt |
| 9,221,228 | B2 | 12/2015 | Wolters et al. |
| 9,227,771 | B2 | 1/2016 | Ueda et al. |
| 9,242,772 | B1 | 1/2016 | Anderson et al. |
| 9,242,773 | B1 | 1/2016 | Anderson |
| 2004/0099686 | A1 | 5/2004 | Rho |
| 2006/0144852 | A1 | 7/2006 | Dubach |
| 2006/0261028 | A1 | 11/2006 | Dubach |
| 2007/0205198 | A1 | 9/2007 | Huber |
| 2008/0105640 | A1 | 5/2008 | Ott |
| 2008/0210745 | A1 | 9/2008 | Rigling |
| 2009/0302037 | A1 | 12/2009 | Rigling |
| 2009/0321382 | A1 | 12/2009 | Fontana |
| 2010/0018992 | A1 | 1/2010 | Dill et al. |
| 2011/0212002 | A1 | 9/2011 | Curry et al. |
| 2012/0138634 | A1 | 6/2012 | Benko et al. |
| 2012/0241471 | A1 | 9/2012 | Barron |
| 2012/0248144 | A1 | 10/2012 | Barron |
| 2013/0043260 | A1 | 2/2013 | Barron |
| 2013/0058595 | A1 | 3/2013 | Elkenhorst |
| 2013/0256336 | A1 | 10/2013 | Himmelsbach et al. |
| 2013/0270293 | A1 | 10/2013 | Dresser |
| 2013/0299511 | A1* | 11/2013 | Wohlgenannt ..... B65D 5/748 222/83 |
| 2014/0083879 | A1 | 3/2014 | Ulstad |
| 2014/0197199 | A1 | 7/2014 | Barron |
| 2014/0224801 | A1 | 8/2014 | Ueda et al. |
| 2014/0230379 | A1 | 8/2014 | Casale et al. |
| 2014/0263313 | A1 | 9/2014 | Besic |
| 2014/0319142 | A1 | 10/2014 | Johansson et al. |
| 2015/0144630 | A1 | 5/2015 | Backes et al. |
| 2015/0151296 | A1 | 6/2015 | Curry et al. |
| 2015/0203257 | A1 | 7/2015 | Canegallo |
| 2015/0225133 | A1 | 8/2015 | Emircan |
| 2015/0307237 | A1 | 10/2015 | Kinsman et al. |
| 2015/0344203 | A1 | 12/2015 | Anderson |
| 2015/0353227 | A1 | 12/2015 | Willemsen et al. |
| 2015/0375911 | A1 | 12/2015 | Stirn |
| 2016/0023823 | A1 | 1/2016 | Barron |
| 2016/0152386 | A1 | 6/2016 | Danielsson et al. |

FOREIGN PATENT DOCUMENTS

| | | | |
|---|---|---|---|
| EP | 1088764 | | 4/2001 |
| EP | 1181203 | | 2/2002 |
| EP | 1262412 | | 12/2002 |
| EP | 1322523 | | 7/2003 |
| EP | 1396435 | | 3/2004 |
| EP | 1399366 | | 3/2004 |
| EP | 1415926 | | 5/2004 |
| EP | 1458623 | | 9/2004 |
| EP | 1465814 | | 10/2004 |
| EP | 1465815 | | 10/2004 |
| EP | 1465830 | | 10/2004 |
| EP | 1509456 | | 3/2005 |
| EP | 1513732 | | 3/2005 |
| EP | 1523732 | | 4/2005 |
| EP | 1562839 | | 8/2005 |
| EP | 1565678 | | 8/2005 |
| EP | 1591367 | | 11/2005 |
| EP | 1608561 | | 12/2005 |
| EP | 1623931 | | 2/2006 |
| EP | 1682443 | | 7/2006 |
| EP | 1795456 | | 6/2007 |
| EP | 1812298 | | 8/2007 |
| EP | 1828002 | | 9/2007 |
| EP | 1863717 | | 12/2007 |
| EP | 1863724 | | 12/2007 |
| EP | 1866211 | | 12/2007 |
| EP | 1868903 | | 12/2007 |
| EP | 1924506 | | 5/2008 |
| EP | 1931571 | | 6/2008 |
| EP | 1976764 | | 10/2008 |
| EP | 1984261 | | 10/2008 |
| EP | 2032458 | | 3/2009 |
| EP | 2055640 | | 5/2009 |
| EP | 2097329 | | 9/2009 |
| EP | 2125542 | | 12/2009 |
| EP | 2143658 | | 1/2010 |
| EP | 2214967 | | 8/2010 |
| EP | 2244955 | | 11/2010 |
| EP | 2287082 | | 2/2011 |
| EP | 2325103 | | 5/2011 |
| EP | 2337747 | | 6/2011 |
| EP | 2344395 | | 7/2011 |
| EP | 2363351 | | 9/2011 |
| EP | 2368808 | | 9/2011 |
| EP | 2377771 | | 10/2011 |
| EP | 2452890 | | 5/2012 |
| EP | 2467302 | | 6/2012 |
| EP | 2483170 | | 8/2012 |
| EP | 2483171 | | 8/2012 |
| EP | 2566768 | | 3/2013 |
| EP | 2566769 | | 3/2013 |
| EP | 2655202 | | 10/2013 |
| EP | 2694392 | | 2/2014 |
| EP | 2741969 | | 6/2014 |
| EP | 2780250 | | 9/2014 |
| EP | 2867126 | | 5/2015 |
| EP | 2897874 | A2 | 7/2015 |
| EP | 2616348 | | 8/2015 |
| EP | 2902336 | | 8/2015 |
| EP | 2576378 | | 10/2015 |
| EP | 2943412 | A1 | 11/2015 |
| EP | 2949594 | | 12/2015 |
| EP | 2956373 | A1 | 12/2015 |
| EP | 2969478 | A1 | 1/2016 |
| EP | 2739539 | | 2/2016 |
| EP | 2989019 | A1 | 3/2016 |
| EP | 2922766 | | 6/2016 |
| EP | 3027524 | | 6/2016 |
| EP | 3010818 | A1 | 8/2016 |
| WO | WO/9505996 | | 3/1995 |
| WO | WO2004/000667 | | 12/2003 |
| WO | WO2003/002419 | | 9/2004 |
| WO | WO2004/083055 | | 9/2004 |

(56) References Cited

FOREIGN PATENT DOCUMENTS

| | | |
|---|---|---|
| WO | WO2006/050624 | 5/2006 |
| WO | WO2006/089440 | 8/2006 |
| WO | WO2007/030965 | 3/2007 |
| WO | WO2008/092289 | 8/2008 |
| WO | WO2009/060005 | 5/2009 |
| WO | WO2009/068671 | 6/2009 |
| WO | WO2013/017316 | 2/2013 |
| WO | WO2013/174562 | 11/2013 |
| WO | WO2014/001507 | 1/2014 |
| WO | WO2014/012692 | 1/2014 |
| WO | WO 2014046633 | 3/2014 |
| WO | WO 2014108797 | 7/2014 |
| WO | WO 2014124794 | 8/2014 |
| WO | WO 2014139788 | 9/2014 |
| WO | WO 2014173952 | 10/2014 |
| WO | WO 2014202518 | 12/2014 |
| WO | WO 2015014553 | 2/2015 |
| WO | WO2015/032754 | 3/2015 |
| WO | WO2015/058912 | 4/2015 |
| WO | WO 2016070949 | 5/2016 |

* cited by examiner

CLOSURE ASSEMBLY

BACKGROUND OF THE INVENTION

The present invention relates generally to a three piece closure for a container. The closure is formed generally of a base, cutter and cap. The closure is configured such that upon initial removal of the cap from the base, the cutter is driven downwards relative to the base so as to form an opening through a portion of the container to which to closure is attached.

SUMMARY OF THE INVENTION

In one embodiment a closure assembly for a container includes a base. The base includes a mounting portion and a neck portion centered and extending about a vertical axis. A thread is formed about an exterior surface of the neck.

A track is formed along an interior surface of the neck. The track is defined by the lower end of a vertical guide that extends generally perpendicularly downwards from an upper portion of the neck and an upper surface of a bottom guide that extends below at least a portion of the lower end of the vertical guide.

The closure assembly further includes a cutter having a cylindrical body. A cutting element extends downwards from a lower end of the cylindrical body. A downwardly angled rib extends about an outer surface of the cutter. A fin extends radially inwards from an inner surface of the cylindrical body.

The closure assembly further includes a cap having a top panel and a skirt extending downwards from an outer periphery of the top panel. The cap also includes a thread configured to interact with the thread of the base to sealingly attach the cap to the base and a drive tab extending downwards from a lower surface of the top panel.

In an assembled, pre-initial opening configuration of the closure assembly, the cutter is located within the neck portion of the base such the bottommost surface of the cutting element is located above a lowermost portion of the neck portion and the cap is sealingly attached to the base by an engagement of the thread of the cap with the thread of the base.

Upon initial removal of the cap from the base, rotation of the cap relative to the base results in the engagement of the drive tab with the fin, causing the cutter to be rotated relative to the base. The rotation of the cutter relative to the base results in the rib entering into and traveling downwards along the track as the cap is rotated relative to the base. The downward rotational movement of the cutter relative to the base causes the cutting element to move to a position in which the bottommost surface of the cutting element extends below the lowermost portion of the cap.

In some embodiments, in the assembled, pre-initial opening configuration of the closure, a bottommost surface of the rib of the cutter may rests upon the upper surface of the bottom guide. Also, in the assembled, pre-initial opening configuration of the closure, an end engagement surface of the rib may be located adjacent a first vertically extending end surface of the vertical guide.

In some embodiments, the track may further be defined by a helical guide extending along a downward angle from a second vertically extending end surface of the vertical guide, such that the track is defined between a lower end of the helical guide and the upper surface of the bottom guide.

In some embodiments, the fins of the cutter may be configured to deflect in a radially outwards direction when the cap attached to the base.

In some embodiments, the rotation of the cap upon initial removal of the cap may cause rotation of the cutter in the same direction as the direction of the rotation of the cap.

In some embodiments, the base may further include a retaining structure located about the lowermost portion of the interior surface of the neck portion configured to engage a bottommost surface of the rib to prevent removal of the cutter through a bottom opening defining the lowermost portion of the neck portion.

In one embodiment, a closure assembly for a container includes a base having a mounting portion and a neck portion centered and extending about a vertical axis.

A first guide element extends generally perpendicularly downwards along the interior surface of the neck from an upper portion of the neck. The first guide has a width as measured in an angular direction that defines a first distance.

A second guide element extends along the interior surface of the neck. At least a portion of the second guide is located below a lowermost surface of the first guide. A track is defined between the first guide element and the second guide element.

The closure assembly further includes a cutter having a cylindrical body. One or more cutting elements extend downwards from a lower end of the cylindrical body. One or more fins extend radially inwards from an inner surface of the cylindrical body. Two or more downwardly angled ribs extend about an outer surface of the cylindrical body.

The first end of a first rib is spaced apart a second distance as measured in an angular direction from a second end of a second rib located adjacent the first rib. The first distance is substantially the same as the second distance.

In an assembled configuration of the cutter and base, the cutter is positioned within the neck of the base such that the first guide element is positioned in the space defined between the first end of the first rib and the second end of the second rib.

The first and second guide elements are arranged to define the track such that upon rotation of the cutter relative to the base, the cutter is moved rotationally downwards relative to the base as the ribs of the cutter travel along the track.

In some embodiments, the closure assembly may include one or more frangible attachments initially connecting the base to the cutter. The one or more frangible attachments extend between an upper portion of the neck portion of the base and a lower portion of the cylindrical body of the cutter. The attachments may be arranged between the base and the cutter to define a first base and cutter configuration in which the portion of the cutter defining the space between the first end of the first rib and the second end of the second rib extends directly above the portion of the base about which the first guide is formed.

In some embodiments, following breaking of the attachments, the bottommost surfaces of ribs may be configured to rest on top of the uppermost surface of the second guide element in a second base and cutter configuration. The transition from the first configuration to the second configuration of the base and cutter may be effectuated by only an axial movement of the cutter relative to the base, without requiring any rotation of the cutter relative to the base.

In some embodiments, the closure assembly may include a cap having a top panel, a skirt extending from an outer periphery of the top panel, and a thread extending about an interior surface of the skirt. The transition from the first configuration to the second configuration of the base and cutter may cause by the attachment of the cap to the base. The attachment of the cap to the base may be achieved by threading the thread of the cap onto a thread extending about an outer surface of the neck portion of the base.

In one embodiment, a method of assembling a closure for a container includes providing a base having a mounting portion, a neck portion centered and extending about a vertical axis, and a thread formed about an exterior surface of the neck. A guide element is formed about an inner surface of the neck portion.

The method of assembling the closure further includes providing a cap having a top panel, a skirt having a thread formed on an inner surface, and one or more drive tabs extending horizontally downwards from a lower surface of the top panel.

The method of assembling the closure further includes providing a cutter attached to and integral with the base. The cutter includes a cylindrical body and one or more frangible bridges attached between the cylindrical body of the cutter and the neck portion of the base. A cutting element extending downwards from a lower end of the cylindrical body.

One or more catches extend radially inwards from an inner surface of the cylindrical body and are configured to interact with the one or more drive tabs to cause rotation of the cutter. Two or more cams extend about an outer surface of the cutter, and are configured to engage with the guide element of the base to move the cutter from an assembled configuration to a piercing configuration in which the bottommost surface of the cutting element extends below a lowermost portion of the neck portion.

The method of assembling the closure further includes attaching the cap to the base to seal the base by engaging the thread of the cap with the thread of the base. The step of attaching the cap is defined by an initial movement of the cap relative to the base in a purely axial direction and a second subsequent movement of the cap relative to the base in a combined rotational and axial direction.

The downwards movement of the cap relative to the base causes the breakage of the one or more frangible bridges attaching the cutter and the base and also results in the movement of one or both of the cutter and the base relative to one another such that following the attachment of the cap to the base, the cap, the base, and the cutter are arranged in an assembled configuration in which the cutter is positioned radially inwards within the base and the cap is sealingly engaged with the neck portion of the base.

In some embodiments, the method of assembling the closure may further include attaching the assembled closure to a container along a portion of the mounting portion. In some embodiments, the movement of one or both of the cutter and the base relative to one another to position the cutter within the base may occurs without any rotation of the cutter relative to the base, and involves only movement in an axial direction.

In some embodiments, the step of unscrewing the cap from the base after the assembled closured has been attached to the container may cause a downwards rotational movement of the cutter relative to the base that creates an opening the container.

In one embodiment, a closure for a container includes a base having a sealing rim having a first side, a second side and an opening extending from the first to the second side. A membrane is sealed to the second side to cover the opening.

A cylindrical neck is formed about a longitudinal axis and extends from the first side of the sealing rim. The neck includes an interior surface surrounding the opening and a track formed on the interior surface. The track is defined by a first elongated guide element formed substantially parallel to the longitudinal axis on the interior surface. The elongated guide element has a tip portion extending at an angle between 5 and 45 degrees relative to the longitudinal axis.

A curved guide element is formed between the tip and the membrane. The curved guide element has a surface facing the tip that extends at substantially the same angle as the tip relative to the longitudinal axis. A neck thread extends about an exterior surface of the cylindrical neck.

The closure further includes a cutter having a cylindrical body and a cutting element extending downwards from a lower end of the cylindrical body. A downwardly angled rib extends about an outer surface of the cutter and a fin extends radially inwards from an inner surface of the cylindrical body.

The closure further includes a cap having a top panel, a skirt extending downwards from an outer periphery of the top panel, and a thread configured to interact with the neck thread to sealingly attach the cap to the neck. A drive tab extends downwards from a lower surface of the top panel.

When the cap is sealed to the neck the cutter is located within the neck of the base such the bottommost surface of the cutting element is located above the membrane. Upon removal of the cap from the neck, rotation of the cap relative to the neck results in the engagement of the drive tab with the fin, causing the cutter to be rotated relative to the base. The rotation of the cutter relative to the base results in the rib entering into the track to move the cutter into engagement with the membrane to cut the membrane as the cap is rotated.

In one embodiment, a closure assembly includes a spout portion integrally molded with a cutter portion. The spout portion has first and second ends and a cylindrical wall extending between said first and second ends. The cutter portion has a cutter blade disposed at one end. The cutter portion is frangibly connected to the spout portion by breakable elements. The cutter blade is received within a space defined by the cylindrical wall of the spout portion and between the first and second ends.

The spout portion may optionally include a flange defining an aperture and the cylindrical wall may optionally surround the aperture and extend away from the flange. The cutter blade may optionally be located between the aperture and an end of the cylindrical wall remote from the flange.

The cutter portion may optionally be frangibly connected to the spout portion at an end of the cylindrical wall remote from the flange.

An end of the cutter portion remote from the cutter blade may optionally extend away from the spout portion and the breakable elements by which the cutter portion is frangibly connected to the spout portion and may optionally be adapted to break upon the application of a force applied to the end of the cutter portion remote from the cutter blade in a direction towards the spout portion.

Upon application of a force to the cutter portion in a direction towards the spout portion and following the breaking of the breakable elements by which the cutter portion is frangibly connected to the spout portion, the cutter portion may optionally be adapted to be received within the spout portion and to move to an assembled position.

Prior to the breaking of the breakable means, the end of the cutter portion remote from the cutter blade may optionally extend away from the spout portion by a distance equal to that travelled by the cutter portion in moving to the assembled position.

The cutter portion may optionally include an annular wall and be disposed coaxially with respect to the cylindrical wall with an end of the annular wall remote from the cutter blade extending axially away from the cylindrical wall. The breakable elements by which the cutter portion is frangibly connected to the spout portion may optionally be adapted to break upon the application of an axial force applied to said end of the annular wall remote from the cutter blade in a direction towards the spout portion. Following the breaking of the breakable elements, the cutter portion may optionally be adapted to be coaxially received within the spout portion and to move to an assembled position.

The end of the annular wall remote from the cutter blade may optionally terminate in a generally flat surface lying in a plane generally transverse, if not orthogonal, to the direction of an applied axial force.

An inner surface of the cylindrical wall may optionally be keyed to an outer surface of the annular wall so as to inhibit relative rotation of the cutter portion and spout portion as the cutter portion is moved to the assembled position.

An inner surface of the cylindrical wall may optionally be provided with two or more formations that project radially inwardly and the annular wall of the cutter portion may optionally be sized so as to be slidingly received between the radially inwardly projecting formations.

An outer surface of the annular wall may optionally be provided with two or more formations that project radially outwardly and the inner surface of the cylindrical wall may optionally be sized so as to slidingly receive the annular wall and the radially outwardly projecting formations.

The cutter portion and spout portion may optionally be aligned such that the radially inwardly projecting formations on the inner surface of the cylindrical wall are circumferentially interposed between the radially outwardly projecting formations on the outer surface of the annular wall.

The cutter portion and spout portion may optionally be aligned such that, following the breaking of the breakable means, the radially inwardly projecting formations on the inner surface of the cylindrical wall pass between the radially outwardly projecting formations on the outer surface of the annular wall as the cutter portion moves to the assembled position.

The cutter portion and spout portion may optionally be aligned such that, upon axial application of the cutter portion to the spout portion, the formations on the cutter portion do not confrontingly engage the formations on the spout portion before the cutter portion reaches the assembled position.

A stop may optionally be provided on one of the inner surface of the cylindrical wall and the outer surface of the annular wall that engages with a formation provided on the other of the inner surface of the cylindrical wall and the outer surface of the annular wall when the cutter portion is in the assembled position.

The radially outwardly projecting formations provided on the outer surface of the annular wall may optionally include a thread configuration.

The radially inwardly projecting formations provided on the inner surface of the cylindrical wall may optionally be axially aligned with channels defined by radially projecting end surfaces of circumferentially adjacent elements of the thread configuration provided on the outer surface of the annular wall.

At a position beyond that reached by the radially outwardly projecting formations provided on the outer surface of the annular wall as the cutter portion moves to the assembled position, the inner surface of the cylindrical wall may optionally be provided with two or more additional formations that comprise a thread configuration complementary to that provided on the outer surface of the annular wall.

The cutter portion and spout portion may optionally be aligned such that, upon axial application of the cutter portion to the spout portion and the cutter portion moving to the assembled position, the thread configuration on the outer surface of the annular wall is rotationally and axially aligned with a start of the complementary thread configuration provided on the inner surface of the cylindrical wall.

A recloseable cap to selectively close the spout portion when the cutter portion is in the assembled position may optionally be provided. The recloseable cap may optionally have a thread configuration for threaded engagement with a complementary thread configuration provided on the spout portion such that, to disengage the respective thread configurations and open the spout portion, the recloseable cap may optionally be rotated with respect to the spout portion.

Drive elements may optionally be provided between the recloseable cap and the cutter portion such that, on first rotating the recloseable cap with respect to the spout portion, the cutter portion is rotated to threadingly engage the thread configuration on the outer surface of the annular wall with the complementary thread configuration provided on the inner surface of the cylindrical wall.

In one embodiment, a method of manufacturing a closure assembly may include the steps of providing a spout portion having first and second ends and a cylindrical wall extending between said first and second ends; providing a cutter portion having a cutter blade disposed at one end; disposing the cutter portion with respect to the spout portion such that the cutter blade is received within a space defined by the cylindrical wall of the spout portion and between said first and second ends; and integrally molding the spout portion and the cutter portion with the cutter portion frangibly connected to the spout portion by breakable elements.

An end of the cutter portion remote from the cutter blade may optionally extend away from the spout portion, and the method may optionally include the further step of: applying a force to the end of the cutter portion remote from the cutter blade in a direction towards the spout portion to break the breakable elements by which the cutter portion is frangibly connected to the spout portion.

Upon application of a force to the cutter portion in a direction towards the spout portion and following the breaking of the breakable elements by which the cutter portion is frangibly connected to the spout portion, the method may optionally include the further step of: moving the cutter portion to an assembled position in which the cutter portion is received within the spout portion.

The cutter portion may optionally include an annular wall and may optionally be disposed coaxially with respect to the cylindrical wall, and the method may optionally include the further steps of providing an inner surface of the cylindrical wall with two or more formations that project radially inwardly, the annular wall of the cutter portion optionally being sized so as to be capable of being slidingly received between the radially inwardly projecting formations; providing an outer surface of the annular wall with two or more formations that project radially outwardly, the inner surface of the cylindrical wall optionally being sized so as to capable of slidingly receiving the annular wall and the radially outwardly projecting formations; and aligning the cutter portion and the spout portion such that, following the breaking of the breakable elements, the radially inwardly projecting formations on the inner surface of the cylindrical wall pass between the radially outwardly projecting formations on the outer surface of the annular wall as the cutter portion moves to the assembled position.

The method may optionally include the further steps of: providing a recloseable cap to selectively close the spout portion when the cutter portion is in the assembled position, the recloseable cap having a thread configuration for threaded engagement with a complementary thread configuration provided on the spout portion; and applying the recloseable cap to the spout portion.

The recloseable cap may optionally be applied to the spout portion by relative rotational movement between the recloseable cap and the spout portion such that the thread configuration on the recloseable cap engages the complementary thread configuration provided on the spout portion.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1A:
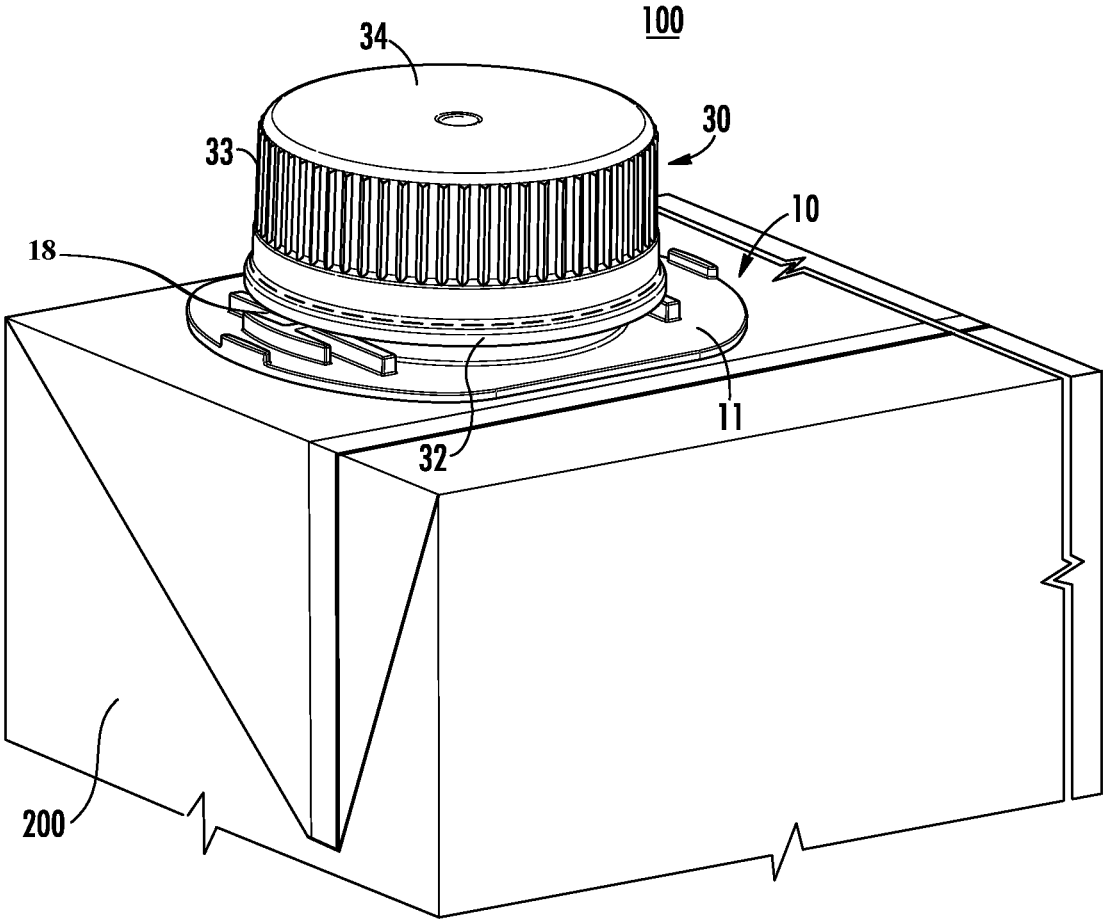
FIG. 1A is a perspective view of a closure assembly in a pre-initial opening configuration attached to a container according to one embodiment.

Shown in FIG. 1A is one embodiment of a three-piece closure assembly 100 in an initial, pre-opening configuration attached to a container 200. The closure assembly 100 comprises a base 10 having a mounting portion 11 configured to be applied/attached to a container 200 to secure the closure assembly 100 to the container 200. Located circumferentially inwards from the neck 12 of the base 10 is a cutter 20. A cap 30 is also provided which is configured to provide a fluid tight seal with the neck 12 of the base 10 when the cap 30 is sealingly engaged with the base 10.

Figure 1B:
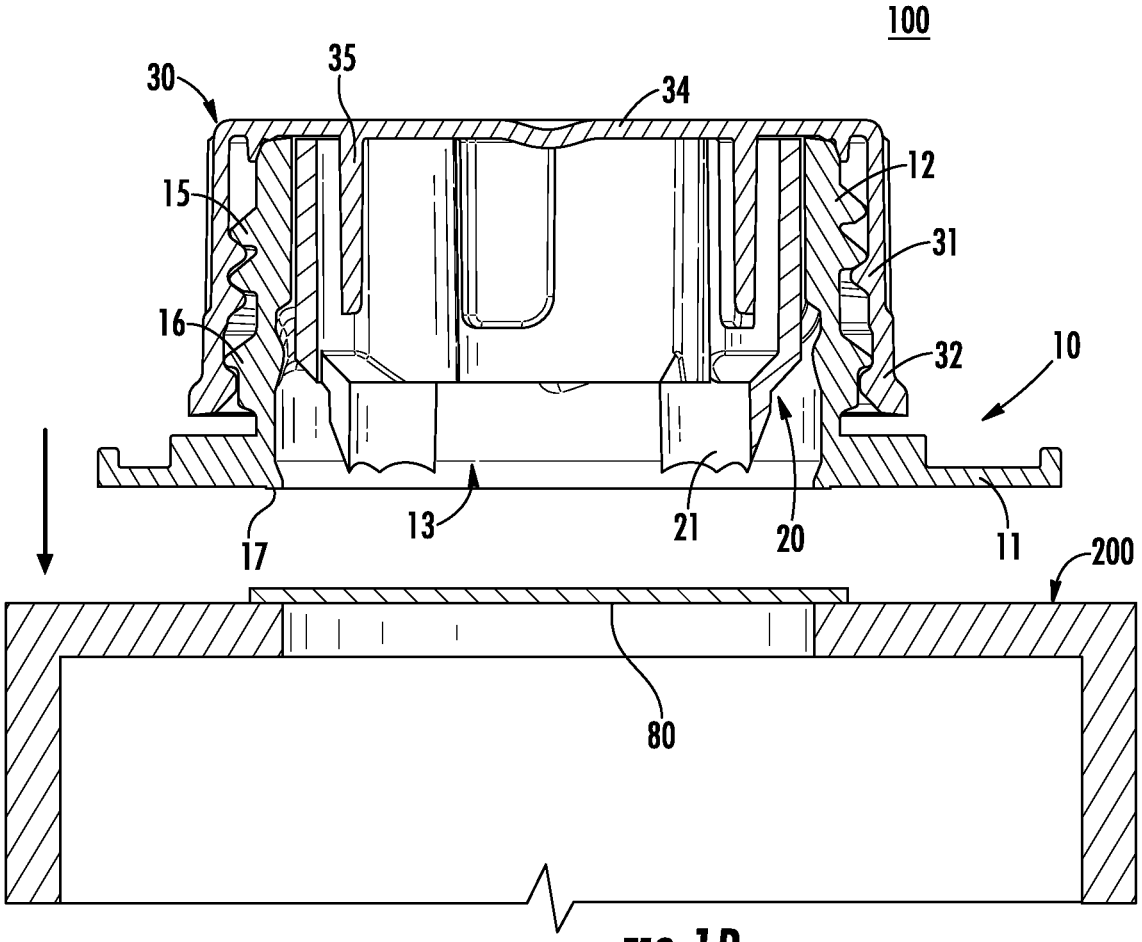
FIG. 1B is a cross-sectional view of the closure assembly in a pre-initial opening configuration immediately prior to attachment of the closure assembly to a container according to one embodiment.

Illustrated in FIG. 1B is one embodiment of a closure assembly 100 in a pre-opening configuration, immediately prior to the closure assembly 100 being attached to a container 200. As illustrated by FIG. 1B, in the initial, pre-opening configuration of the closure assembly 100 the lowermost portion of the cutter 20 is located above a lowermost periphery of the base 10 extending about the flow channel 13 defined by the neck 12, such that the lowermost portion of the cutter 20 is also located above the membrane 80 and/or other structure that initially covers the portion of the container 200 through which the contents of the container 200 will be accessed following initial removal of the cap 30 from the base 10. By having the cutting elements 21 located above a lowermost portion of the base 10 and within the interior of the neck 12 of the base 10 prior to the initial removal of the cap 30 from the base 10, such as, e.g. illustrated in FIG. 1B, damage to the cutting elements 21 as well as unintentional piercing of the membrane may be prevented.

In some embodiments, the portion of the container 200 over which the closure assembly 100, and in particular the cutter 20, is located may be formed from the same material as the remainder of the container 200. In some embodiments, the portion of the container 200 positioned underneath the base 10, and in particular the cutter 20, may be configured to and/or made out of a material configured to allow for easier cutting, piercing, etc. by the cutter 20. For example, this portion of the container 200 through which the contents will be accessed following opening of the closure 100 may: be formed having a smaller thickness than the remainder of the container 200; include a scored or otherwise weakened portion; or, as e.g. illustrated by the embodiment of FIG. 1B, may be formed of a membrane 80 of different material (e.g. foil, film, etc.) than the rest of the container 200, etc. In some embodiments, the base 10 and/or base 10 and cutter 20 may be molded integrally with the container 200, such that the base 10 and/or base 10 and cutter 20 and container 200 are formed as a monolithic assembly.

Figure 1C:
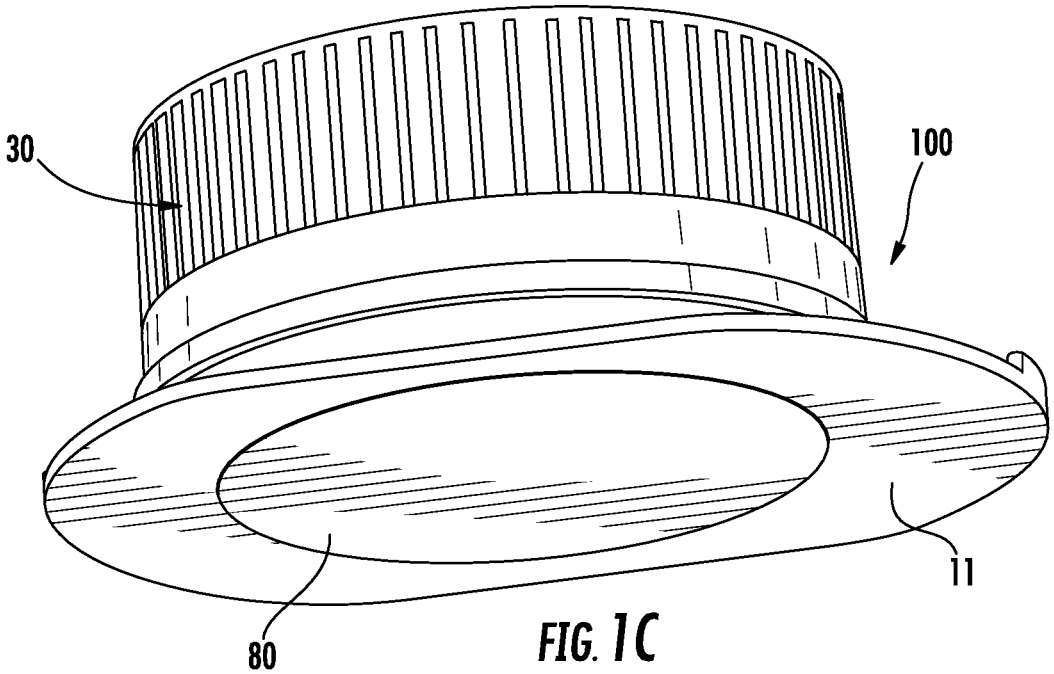
FIG. 1C is a bottom perspective view of a closure assembly in a pre-initial opening configuration formed with a membrane according to one embodiment.

As illustrated in FIG. 1C, in some embodiments, the portion of the container 200 through which the contents of the container 200 will be accessed following initial removal of the cap 30 from the base 10 may initially be sealed by a membrane 80 such as a foil or thin plastic film that is formed with or sealed to the bottom of the mounting portion 11. With this configuration, the closure assembly 100 is manufactured with the membrane 80. The closure assembly 100 is sealed over an opening in the container 200 through which the contents of the container 200 are inserted prior to gluing or heat sealing of the mounting portion 11 to the container 200. In this arrangement, a portion of membrane 80 may be sealed or captured between the surface of the associated container 200 and the bottom of mounting portion 11.

As discussed above, and as shown in the illustrative embodiment of FIGS. 1B and 1C, in various embodiments the portion of the container 200 through which the contents of the container 200 will be accessed following initial removal of the cap 30 from the base 10 may initially be sealed by any one of, or any combination of a portion of the wall of the container 200, a membrane 80 attached to the container 200 (such as, e.g. illustrated in the embodiment of FIG. 1B) and/or a membrane 80 attached to the mounting portion 11 of the base 10 (such as, e.g. illustrated in the embodiment of FIG. 1C). In embodiments in which a membrane 80 is attached to the mounting portion 11, the membrane 80 may be attached to the base 10 at any point during assembly of the closure assembly 100.

Figure 2:
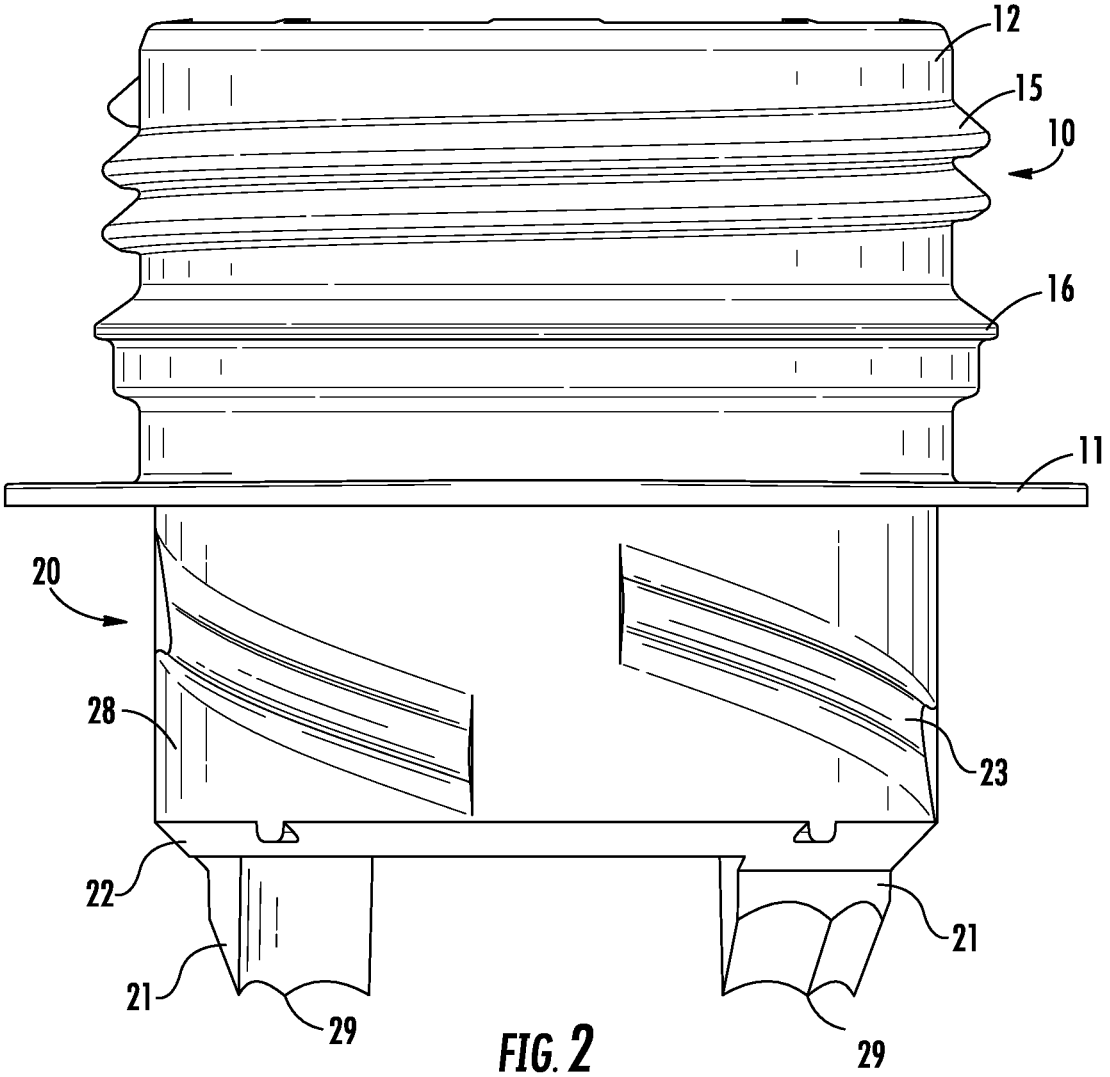
FIG. 2 is a side view of the base and cutter of the closure of FIG. 1A following initial opening of the closure according to one embodiment.

Referring to FIG. 2, one embodiment of a post-initial opening configuration of the cutter 20 and base 10 are illustrated. As described in detail below, upon initial removal of the cap 30 from the base 10, the cutter 20 is forced downwards relative to the base 10 such that the cutting elements 21 of the cutter puncture, pierce, cut, or otherwise penetrate a portion of the container, such as, e.g. membrane 80 to which the closure assembly 100 is attached and/or the membrane 80 extending along the lower surface of mounting portion 11 to provide a fluid passageway through which the contents of the container can be accessed by a user. The cutter 20 remains in this downwardly displaced post-initial opening configuration depicted in FIG. 2 relative to the base 10 during subsequent reapplication and/or removal of the cap 30 from the base 10.

Shown in FIGS. 3A-3F is one embodiment of a base 10 of closure assembly 100. Base 10 generally comprises a neck 12 and a mounting portion 11 extending radially outwards from a lowermost portion of the neck 12. The mounting portion 11 is configured to provide an attachment surface along which the closure assembly 100 may be attached via a fluid-tight, hermetic seal to a container. In some embodiments, the mounting portion 11 may be provided with an adhesive to secure the base 10 to the container. In other embodiments, the mounting portion 11 may be configured to be welded to a container. In yet other embodiments, any other number or combination of other securement elements and/or mounting arrangements may be utilized to attach the base 10 to the container.

The closure assembly 100 can be attached to the container along any one of the top surface, the bottom surface, and/or both the top and bottom surfaces of the mounting portion 11. Although the mounting portion 11 is illustrated as comprising a substantially planar surface that extends substantially perpendicular to the neck 12, in other embodiments the mounting portion 11 may extend at a non-90° angle relative to a longitudinal axis about which the neck 12 is centered and/or the mounting portion 11 may extend along and be defined by surfaces that are not entirely co-planar.

Figure 3A:
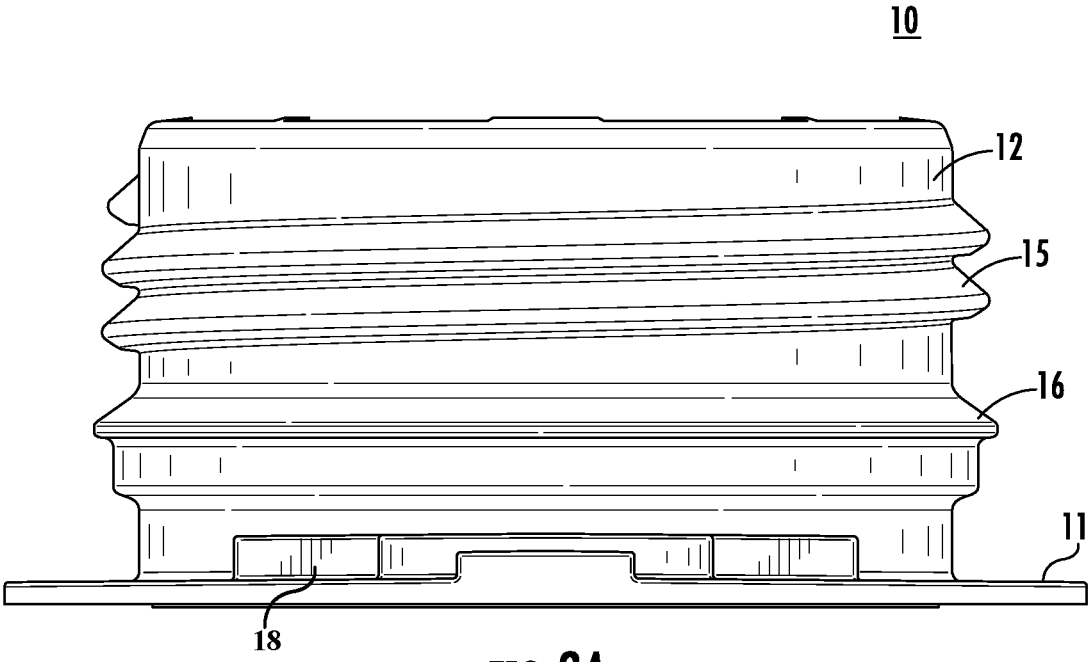
FIG. 3A is a side view of the base of the closure of FIG. 1A according to one embodiment.
Figure 3B:
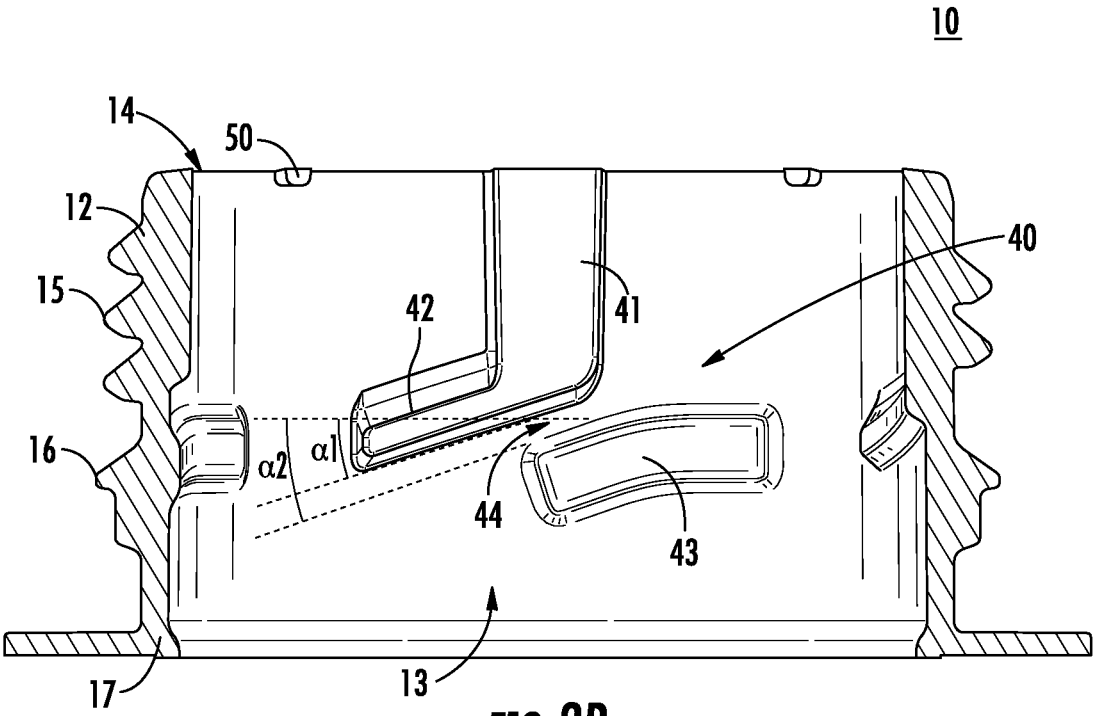
FIG. 3B is a cross-sectional view of the base of FIG. 3A.
Figure 3C:
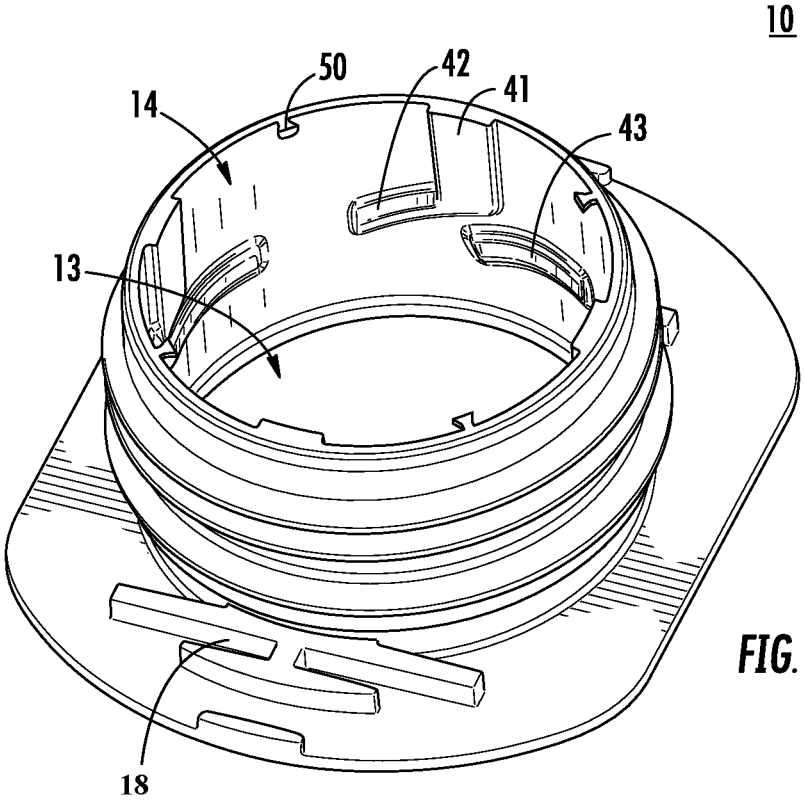
FIG. 3C is a top perspective view of the base of FIG. 3A.
Figure 3D:
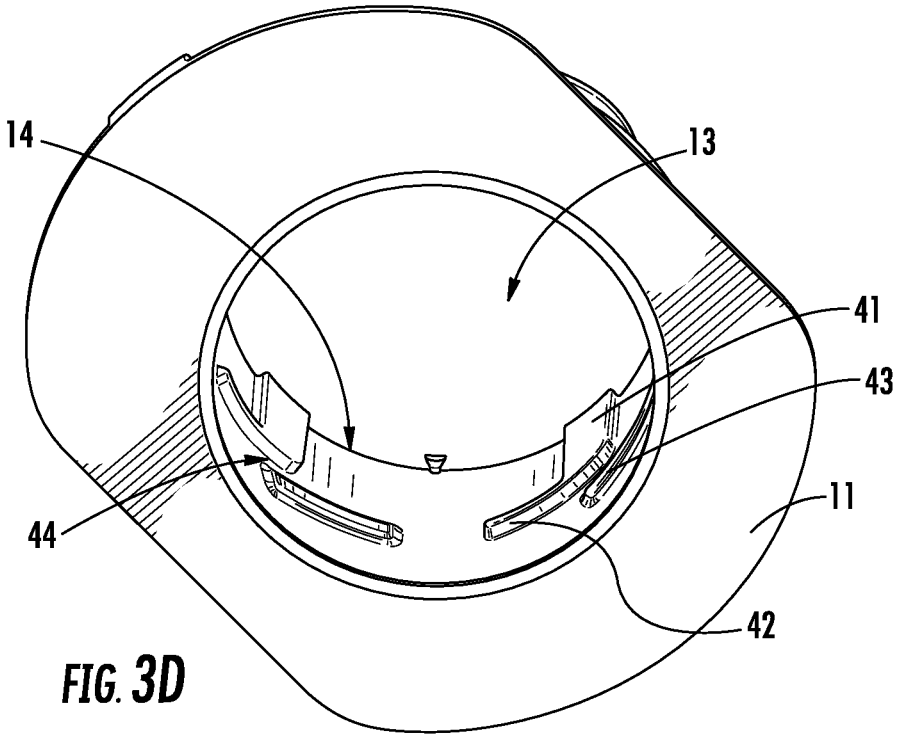
FIG. 3D is a bottom perspective view of the base of FIG. 3A.
Figure 3E:
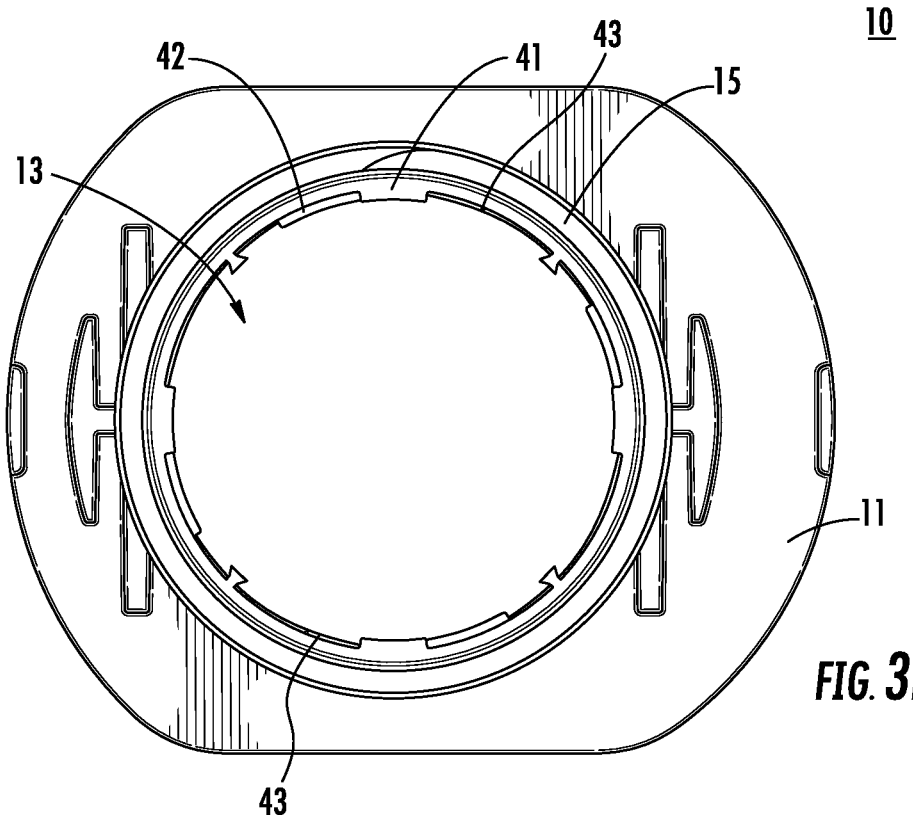
FIG. 3E is a top view of the base of FIG. 3A.
Figure 3F:
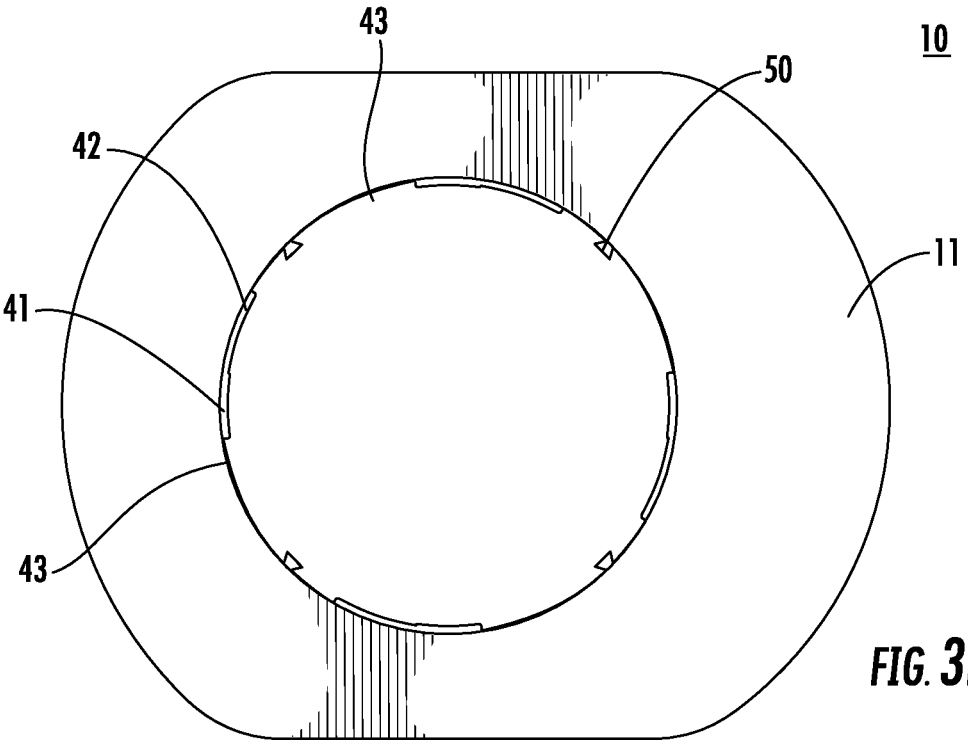
FIG. 3F is a bottom view of the base of FIG. 3A.

Referring to FIG. 3B, the neck 12 of base 10 is defined at an upper end by an opening 14 that provides access to a flow channel 13 extending though the neck 12. Located about the exterior of the neck 12 is a thread 15 configured to interact with a corresponding thread 31 formed on the cap 30. Optionally provided about the outer surface at the lower portion of the neck 12 may be a tamper-evidencing engagement structure 16 that is configured to interact with a tamper band 32 formed on the cap 30 so as to indicate to a user that the cap 30 has been previously removed from the closure assembly 100. As illustrated in FIG. 3C, located about an upper surface of mounting portion 11 may optionally be one or more ribs 18 configured to prevent the tamper band 32 from tiring off upon removal of the cap 30 from the base 10.

Located about an innermost surface of the neck 12 at the lowermost end of the neck 12 are one or more radially inwardly extending retention elements, such as annular bead 17. Annular bead 17 has a diameter that is smaller than an outermost diameter of the ribs 23 formed on the exterior of the cutter 20, such that the cutter 20 is prevented from accidentally or unintentionally being removed through the bottom of the base 10. Although not shown, the base 10 may include similar one or more retention beads located about an innermost surface of the neck 12 at the uppermost end of the neck 12 to prevent accidental or unintentional removal of the cutter 20 through the opening 14 of neck 12.

Formed about and extending radially inwards from the inner surface of neck 12 are a plurality of guide elements 40 configured to guide the cutter 20 downwards upon initial removal of the cap 30 from the base 10. As shown in FIG. 3B, in one embodiment the guide elements 40 may comprise one or more locator guides 41, one or more helical guides 42, and/or one or more bottom guides 43 that are positioned on and extend radially inwards from the inner surface of the neck 12 of base 10. In some embodiments, such as e.g. illustrated in FIG. 3B, the helical guide 42 may be attached to and extend downwardly from a lower portion of locator guide 41. In some embodiments, the locator guide 41 and the helical guide 42 may be formed as discrete elements on the interior of the neck 12.

In some embodiments, the angle $\alpha 1$ of the lowermost surfaces of locator guide 41 and/or helical guide 42 relative to the horizontal axis and the angle $\alpha 2$ of the uppermost portion of the downward angled portion of bottom guide 43 relative to the horizontal axis may be substantially the same. In other embodiments, these angles may be different, with the angle $\alpha 1$ of the lowermost surfaces of the locator guide 41 and/or helical guide 42 being greater or less than the angle $\alpha 2$ of the upper most portion of the downward angled portion of the bottom guide 43.

The angle $\alpha 3$ of the track 44 my correspond to the angle $\alpha 1$ of the lowermost surfaces of locator guide 41 and/or helical guide 42 relative to the horizontal axis, the angle $\alpha 2$ of the uppermost portion of the downward angled portion of bottom guide 43 relative to the horizontal axis, and/or an angle in between the angle $\alpha 1$ of the lowermost surfaces of locator guide 41 and/or helical guide 42 relative to the horizontal axis and the angle $\alpha 2$ of the uppermost portion of the downward angled portion of bottom guide 43 relative to the horizontal axis.

In one embodiment, the angle $\alpha 1$ of the lowermost surfaces of locator guide 41 and/or helical guide 42 relative to the horizontal axis is approximately 0° and 70°, more specifically between approximately 15° and 55°, and in particular approximately between 20° and 50°. In one embodiment, the angle $\alpha 2$ of the uppermost portion of the downward angled portion of bottom guide 43 relative to the horizontal axis is approximately 5° and 60°, more specifically between approximately 10° and 45°, and in particular between approximately 15° and 35°. In one embodiment, the angle $\alpha 3$ of the track 44 relative to the horizontal axis is approximately 5° and 45°, more specifically between approximately 10° and 40°, and in particular between approximately 25° and 35°.

Referring to FIG. 3B, a portion of the bottom surface of the helical guide 42 and/or locator guide 41 and a portion of the upper surface of the downwardly angled portion of the bottom guide 43 define a track 44. In embodiments such as, e.g. that of FIG. 3B, where the helical guide 42 and locator guide 41 are formed as a single element, the track 44 may be defined between the upper surface of the downwardly angled portion of the bottom guide 43 and the bottom surface of the helical guide 42. In some embodiments where the helical guide 42 and the locator guide 41 are formed as discrete elements, the track 44 may be defined between the upper surface of the downwardly angled portion of the bottom guide 43 and the bottom surface of the locator guide 41.

In some embodiments, the angle $\alpha 1$ of the track 44 as measured relative to the horizontal axis is approximately 10° and 40°, more specifically between approximately 15° and 25°, and in particular approximately 20°

Figure 4A:
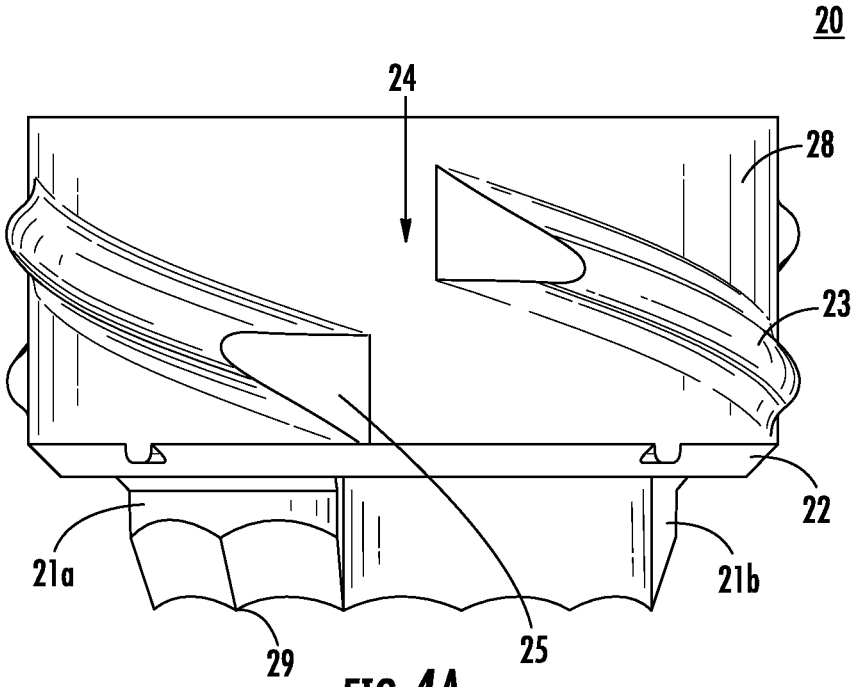
FIG. 4A is a side view of the cutter of the closure of FIG. 1A according to one embodiment.
Figure 4B:
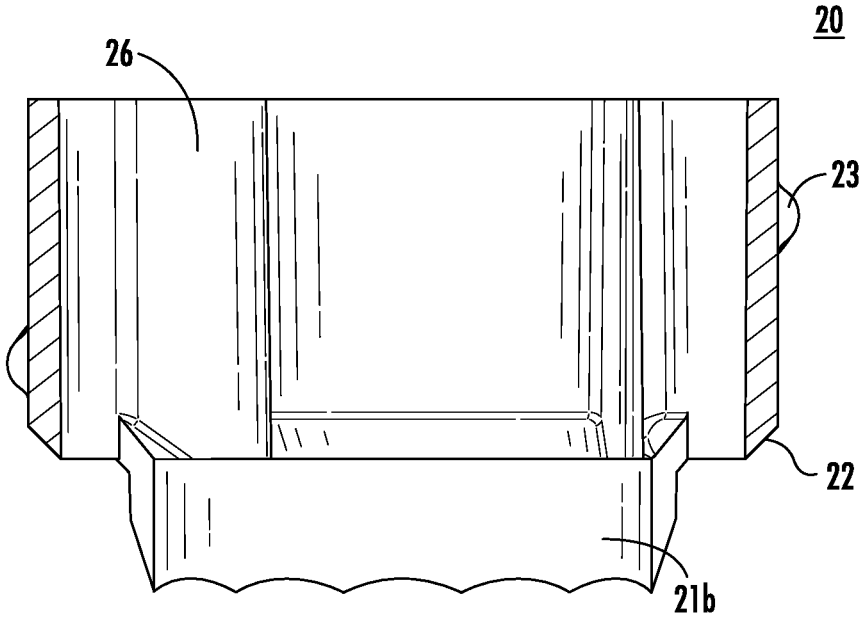
FIG. 4B is a cross-sectional view of the cutter of FIG. 4A.
Figure 4C:
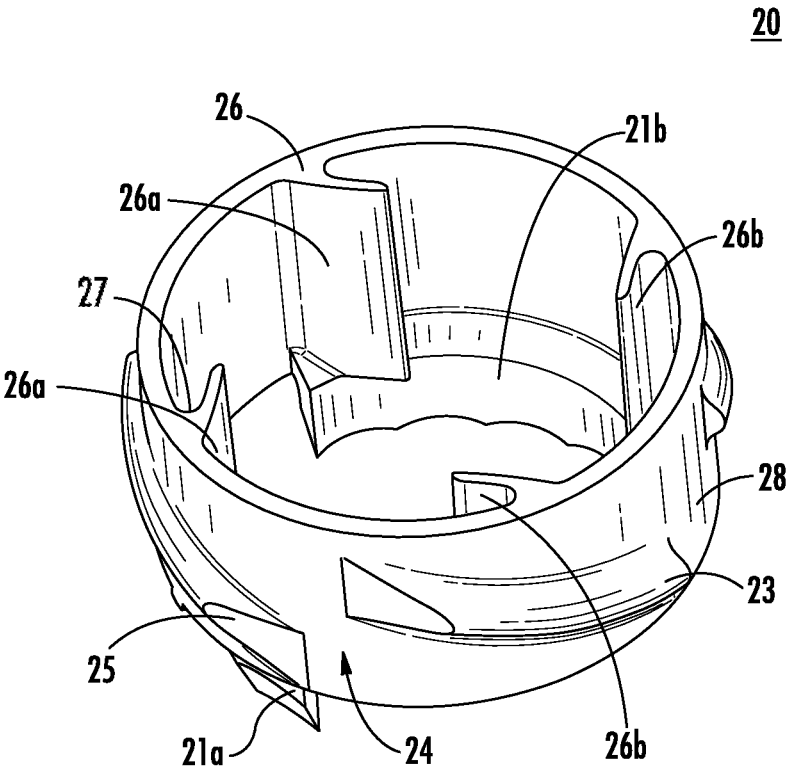
FIG. 4C is a top perspective view of the cutter of FIG. 4A.
Figure 4D:
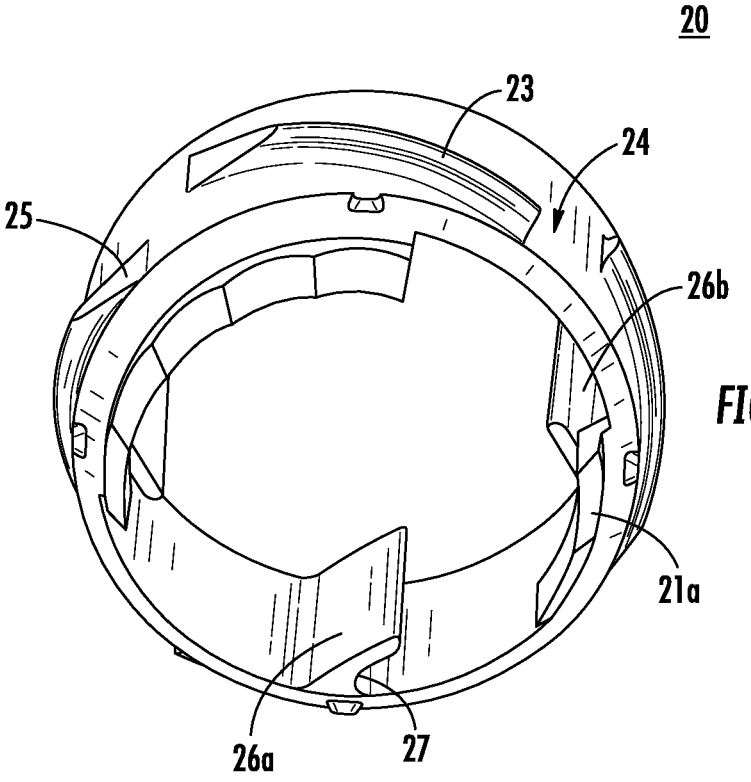
FIG. 4D is a bottom perspective view of the cutter of FIG. 4A.

Referring to FIGS. 4A-4F, various views of a cutter 20 according to one embodiment are illustrated. As shown in FIG. 4A, the upper portion of cutter 20 is defined by a cylindrical body 28 that is defined at its lower end by a bottom rim 22. Formed from and extending downwards from or about at least a portion of the periphery of the bottom rim 22 are one or more cutting elements 21. The cutting elements 21 are configured to create an opening into the container upon initial removal of the cap 30 from the base 10.

In some embodiments, the cutting elements 21 are arranged such that the cutting elements 21 do not extend about the entirety of the periphery of the bottom rim 22, such that a portion of the container remains uncut following initial removal of the cap 30, so as to prevent the cut portion of the container from being entirely separated from and falling into the interior of the container. In one embodiment, such as e.g. shown in FIGS. 4A-4F, the cutting element 21 may comprise a first set 21*a* and a second set 21*b* of cutting elements 21.

In the embodiment of cutter 20 of FIGS. 4A-4F, each of the first set 21*a* and second set 21*b* of cutting elements 21 may be formed having a unitary, monolithic, serrated blade surface formed of a series of interconnected teeth 29. In some embodiments, such as e.g. the embodiment of the cutter 20 illustrated in FIGS. 4A-4F, the tips of each of the teeth 29 lie along the same plane and extend an equal distance downwards relative to the bottom rim 22 of the cutting element 21.

Figure 4E:
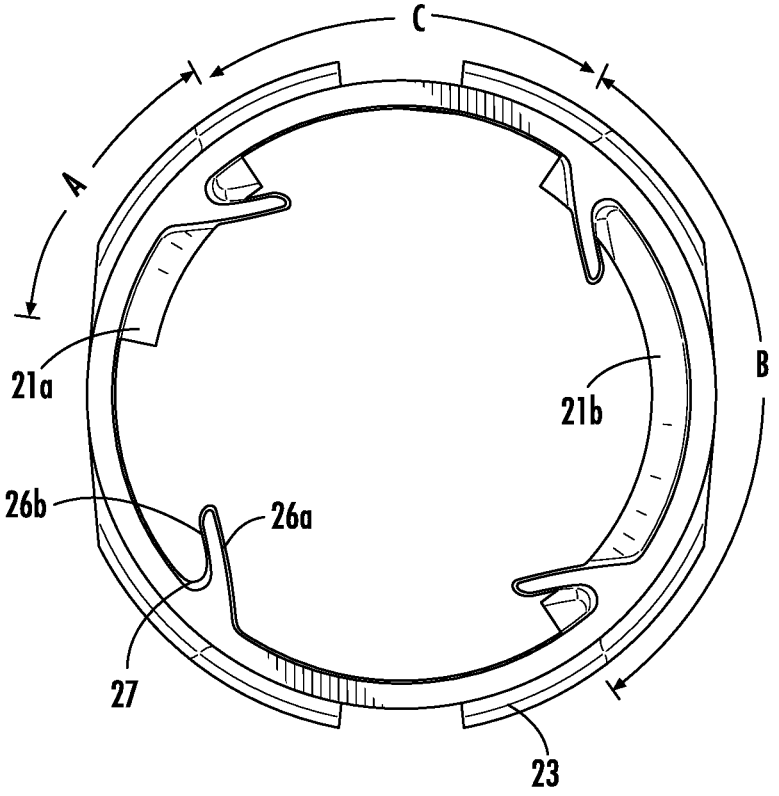
FIG. 4E is a top view of the cutter of FIG. 4A.
Figure 4F:
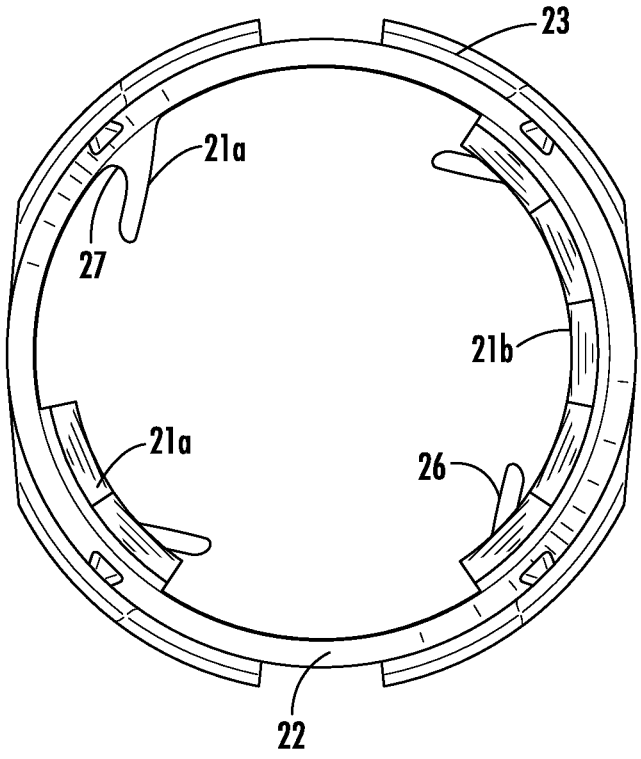
FIG. 4F is a bottom view of the cutter of FIG. 4A.

As shown in FIG. 4F, in one embodiment the angular lengths of the first set 21*a* and second set 21*b* of cutting elements 21 differ. In particular, in one embodiment, the length of the first set 21*a* as measured in a circumferential direction may be less than the length of the second set 21*b* as also measured in a circumferential direction. In such a configuration, the first set 21*a* may act as the leading cutting element 21 and the second set 21*b* may act as the lagging cutting element 21. During initial removal of the cap 30, as the cutter 20 is moved downward in a counterclockwise direction, the lagging second set 21*b* of the cutting element 21 may be configured to radially push outwards the portion of the container cut/perforated by the leading first set 21*a* of cutting elements 21, so as to prevent the cut portion of the container from occluding the opening in the container formed by the cutter 20.

Referring to FIG. 4E, in one embodiment, when viewed from the top, the angular distance A between the ends of the first set 21*a* is between approximately 35° and 55°, and more specifically approximately 45°. The angular distance B between the ends of the second set 21*b* is between approximately 105° and 120°, and more specifically approximately 112.5°. As viewed from the top, such as in FIG. 4E, an angular distance C is defined between the clockwise facing end of the first set 21*a* and the counterclockwise facing end of the second set 21*b* is between approximately 60° and 75°, and more specifically approximately 67.5°.

In the embodiment of FIGS. 4A-4F, the cutter 20 is configured to be rotated between approximately 90° and 130°, more specifically between approximately 100° and 120°, and in particular approximately 110° upon initial removal of the cap 30 from the base 10. As a result of this rotation, the cutter 20 is configured to create a generally circular opening through the container, with between approximately 280° and 320°, more specifically between approximately 290° and 310°, and in particular approximately 300° of the outer circumference of the opening being detached from the remainder of the container following removal of the cap 30 from the closure assembly 100. The remaining between approximately 40° and 80°, more specifically between approximately 50° and 70°, and in particular approximately 60° of the outer circumference of the opening formed in the container remains uncut and attached to the container.

It is to be understood that in other embodiments, the cutting element 21 may be formed from any number of sets of cutting elements 21 having any number of configurations. For example, the cutting element may be formed having any number of blade-like elements, with the lengths, sizes, shapes, and other characteristics of the each of the blade-like elements and/or the teeth 29 forming the blade-like elements being the same of different form the other blade-like elements and/or teeth 29 forming the cutting element 21.

As illustrated in FIG. 4A, located along an exterior surface of the body 28 of cutter 20 are one or more radially outwardly extending ribs 23. The ribs 23 extend along a portion of the exterior surface of the body 28 of the cutter 20 located between the top of the cutter 20 and the bottom rim 22. The portion of the exterior surface of body 28 of the cutter 20 extending radially between adjacent ribs 23 defines a keyway 24. The ribs 23 extend at a non-zero degree angle relative to the horizontal axis. In one embodiment, such as that of FIGS. 4A-4F, the ribs 23 extend downward relative to the horizontal axis at an angle $\alpha 4$ between approximately 5° and 60°, more specifically between approximately 10° and 50°, and in particular approximately 15° and 35°.

In various embodiments, the cutter 20 may be formed with any number of ribs 23. In one embodiment, the cutter 20 may be formed with three or more ribs 23 to increase the stability of the movement of the cutter 20 during rotation of the cutter 20 relative to the base 20 by preventing the ribs 23 from being cocked and jammed within the neck 12 of the base 10 during rotation of the cutter relative to the base 10, as well as to provide a more secure, smooth and reliable movement of the cutter 20 in the rotationally downward direction during the initial removal of the cap 30 from the base 10.

In various embodiments, the angle $\alpha 4$ of the ribs 23 may generally corresponds to any one of: the angle $\alpha 3$ of the track 44, the angle $\alpha 1$ of the lowermost surfaces of locator guide 41 and/or helical guide 42 relative to the horizontal axis, the angle $\alpha 2$ of the uppermost portion of the downward angled portion of bottom guide 43 relative to the horizontal axis, and/or an angle in between the angle $\alpha 1$ of the lowermost surfaces of locator guide 41 and/or helical guide 42 relative to the horizontal axis and the angle $\alpha 3$ of the uppermost portion of the downward angled portion of bottom guide 43 relative to the horizontal axis.

In some embodiments, the bottom end surface 25 of each rib 23 may define a stop surface that is configured to interact with the retention element, such as e.g. annular bead 17, that may be provided along the bottom of the interior surface of the neck 12 of base 10. Similarly, in some embodiments, the top end surface of each rib 23 may define a stop surface configured to interact with a retention element that may be provided along the inner surface of 12 at a location about the opening 14 of the neck 12.

As illustrated in FIGS. 4E and 4F, extending radially inwards from the interior surface of the cutter 20 are one or more fins 26. In some embodiments the fins 26 may be generally rigid, while in other embodiments the fins 26 may be generally resilient and/or elastic. The fins 26 extend inwards from the inner surface of the body 28 of cutter 20 at an angle. When viewed from the top, such as illustrated in FIG. 4E, each fin 26 defines a counter-clockwise facing surface 26*a* and a clockwise facing surface 26*b*. An engagement surface 27 is defined by the intersection of the clockwise facing surface 26*b* of the fins 26 with the inner surface of the body 28 of the cutter 20.

Figure 5A:
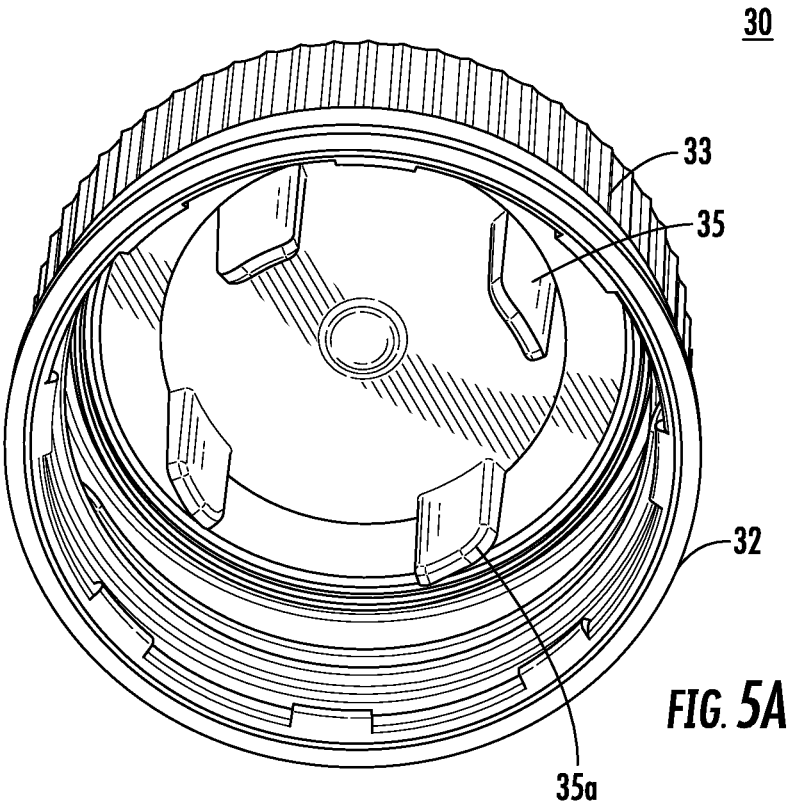
FIG. 5A is a bottom perspective view of the cap of the closure of FIG. 1A according to one embodiment.
Figure 5B:
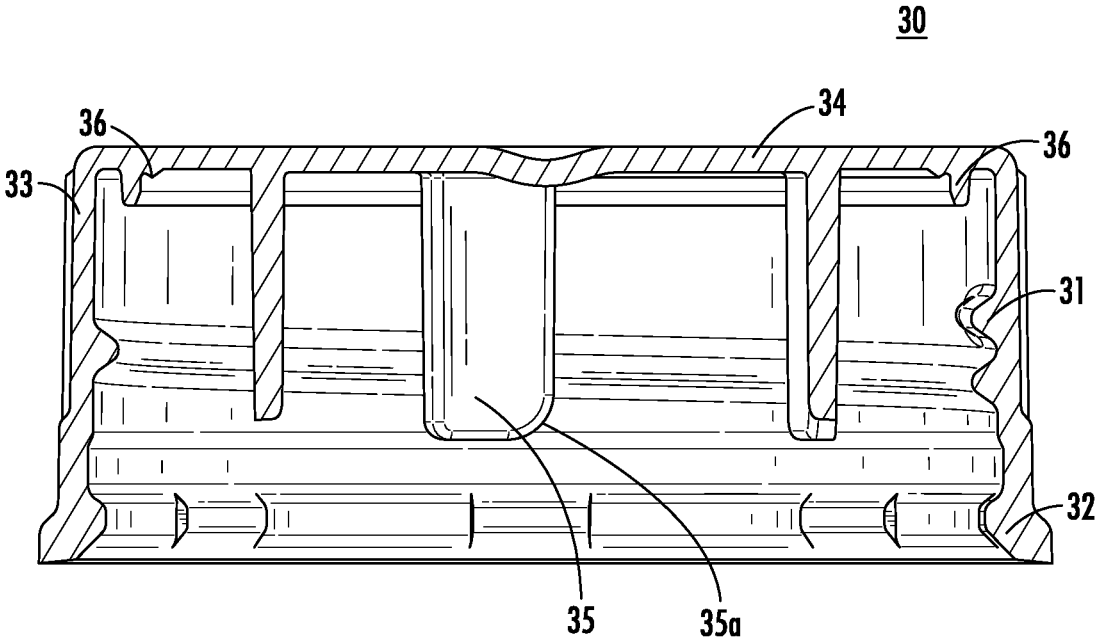
FIG. 5B is a cross-sectional view of the cap of FIG. 5A.

Turning to FIGS. 5A and 5B, one embodiment of a cap 30 is illustrated. Cap generally comprises a top panel 34 and a skirt 33 extending generally perpendicularly downwards from an outer periphery of the top panel 34. In some embodiments, the cap 30 may be provided with a tamper evidencing feature, such as a tamper band 32, which extends downwards from a lower portion of the skirt 33.

Located along an inner surface of the skirt 33 of the cap 30 is a thread 31 configured for engaging the corresponding thread 15 formed on the neck 12 of base 10. Optionally provided on a lower surface of the top panel 34 are one or more sealing elements 36 configured to engage the opening 14 of neck 12 to provide a fluid-tight seal when the cap 30 is sealingly attached to the base 10.

Extending vertically downwards from a bottom surface of the top panel 34 in a direction substantially parallel to the vertical axis are one or more drive tabs 35. In some embodiments, the tabs 35 may be generally flexible and elastic, while in other embodiments the tabs 35 may be generally rigid. As shown in FIGS. 5A and 5B, in some embodiments, the clockwise facing ends of the tabs 35 may define a beveled surface 35*a*.

In some embodiments, such as, e.g. the embodiment of cap 30 of FIGS. 5A and 5B, the drive tabs 35 are generally arranged and extend along a circular periphery located radially inwards from the inner surface of skirt 33. In other embodiments, the tabs 35 may extend downwards from the top panel 34 along a direction angled at a non-90° angle with respect to the inner surface of the skirt 33. In some embodiments, the tabs 35 may also be spaced and arranged about the top panel 34 in a non-circular manner.

Operation of the closure assembly 100 according to one embodiment is described with reference to FIGS. 1, 2, and 7B. As illustrated in the embodiment of closure assembly 100 of FIGS. 1A and 1B, in the initial, assembled configuration of closure assembly 100 (i.e. prior to initial removal of the cap 30 from the base 10), the cap 30 is attached to base 10 via engagement of the thread 31 of cap 30 to the corresponding thread 15 of base 10 to provide a fluid tight seal of the flow channel 13.

As shown in FIG. 1B, in this initial, assembled configuration, the cutter 20 is located within the neck 12 of base 10, with the ribs 23 of cutter 20 resting atop the upper surfaces 43 of the bottom guides 43. This interaction of the ribs 23 with the upper surfaces 43 of the bottom guides 43 prevents the cutter from moving downwards relative to the base 10 prior to the initial removal of the cap 30. In the initial assembled configuration, the bottommost portion of cutter 20 and cutting elements 21 do not extend downwards past the bottommost portion of the neck 12.

During initial opening of a container assembly sealed by closure assembly 100, the cap 30 is rotated in a counterclockwise direction relative to base 10 to remove the cap 30. As the cap 30 is rotated in the counterclockwise direction, the thread 31 of the cap 30 moves upwards along the thread 15 of the base 10, causing the cap 30 to move in an upwards direction relative to the base 10. As the cap 30 moves upwards relative to the base 10, the tamper band 32 (if included) engages the tamper-evidencing structure 16 of the base, causing the tamper band 32 to break, so as to indicate to a user that the container sealed by the closure assembly 100 has been opened.

Figure 7A:
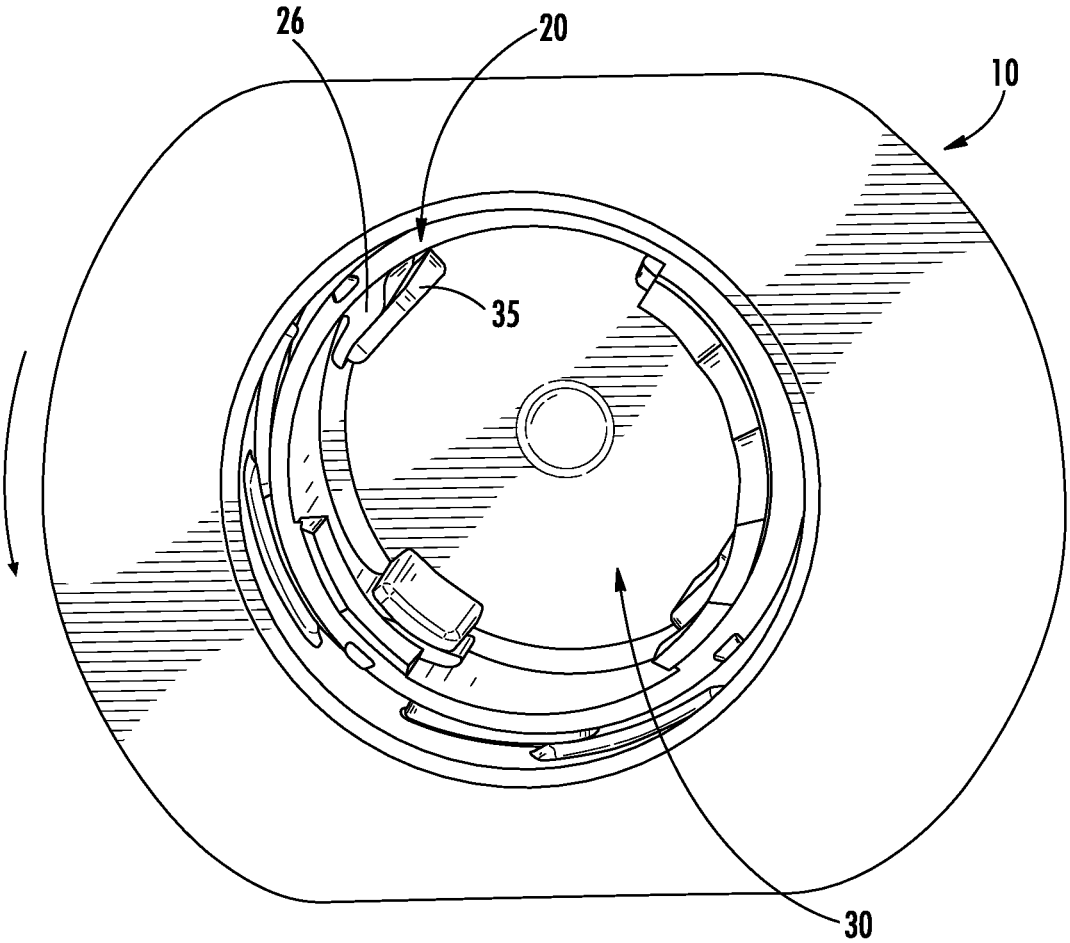
FIG. 7A is a bottom perspective view illustrating the application of the cap to the base during assembly of the closure of FIG. 1A according to one embodiment.
Figure 7B:
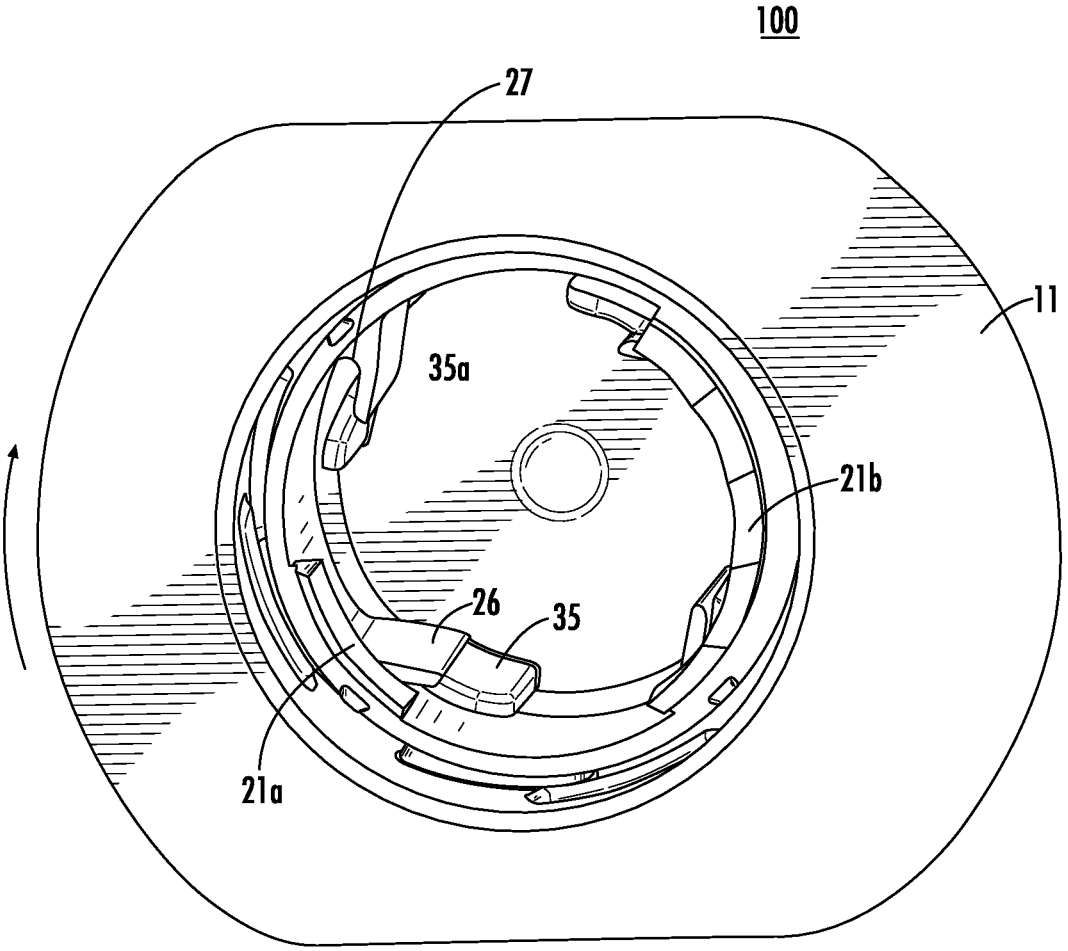
FIG. 7B is a bottom perspective view illustrating the initial removal of the cap from the base during initial removal of the cap from the closure of FIG. 1A according to one embodiment.
Figure 8A:
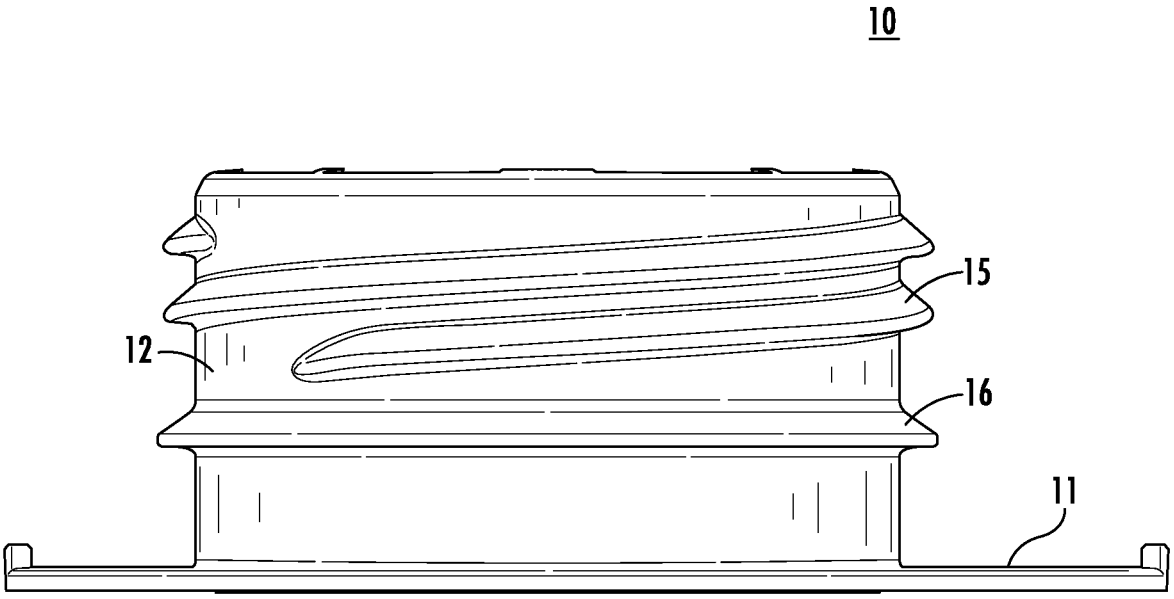
FIG. 8A is a side view of a base according to one embodiment.
Figure 8B:
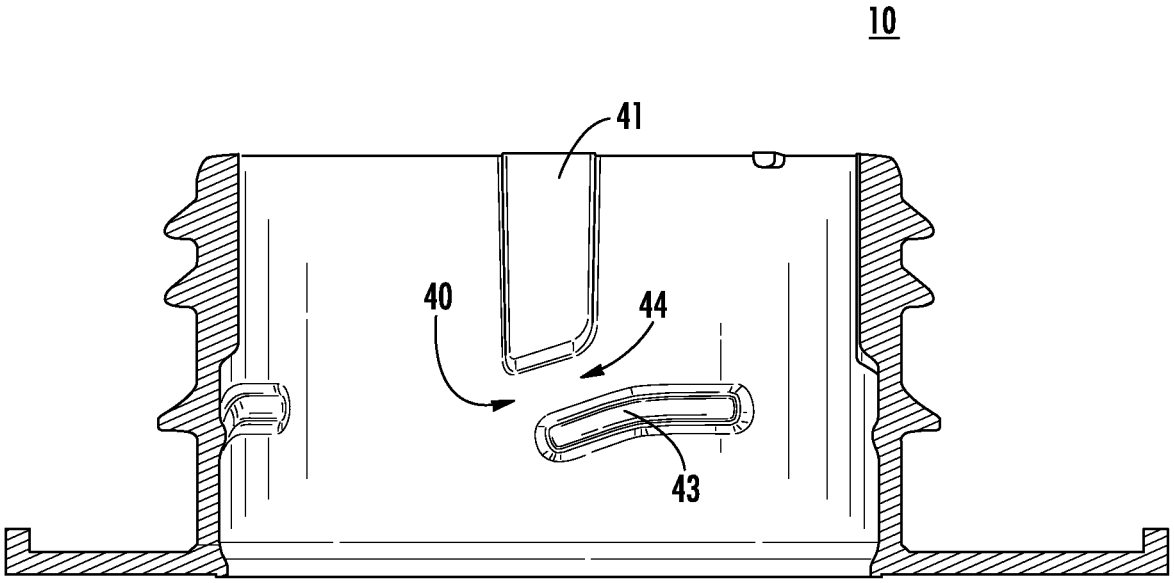
FIG. 8B is a cross-sectional view of the base of FIG. 8A.
Figure 8C:
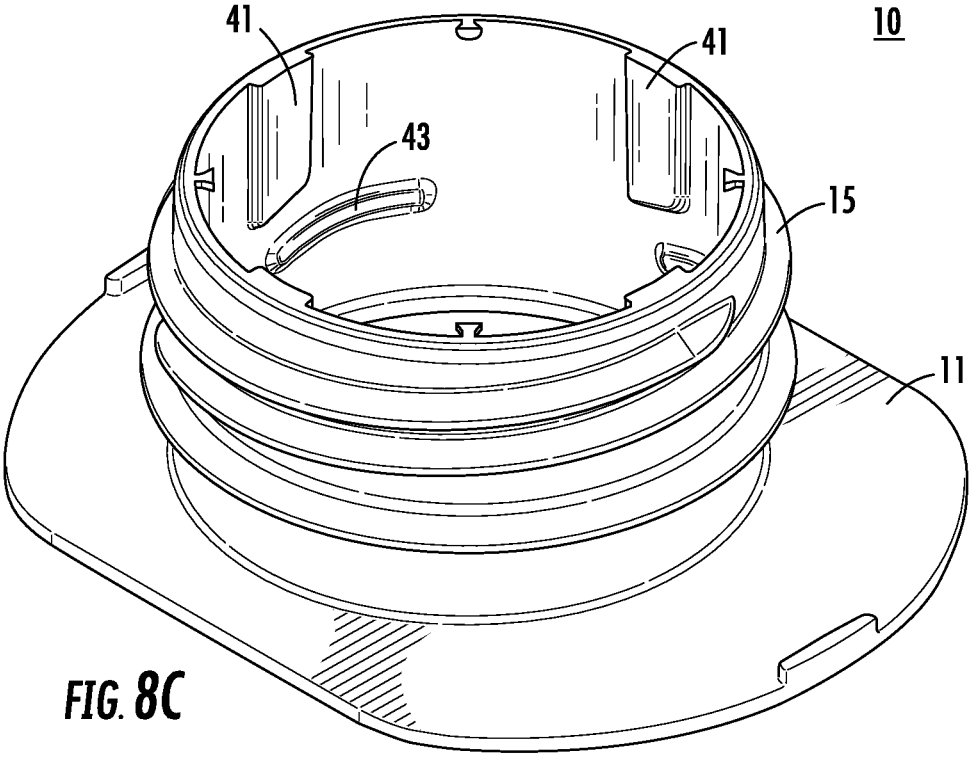
FIG. 8C is a top perspective view of the base of FIG. 8A.
Figure 8D:
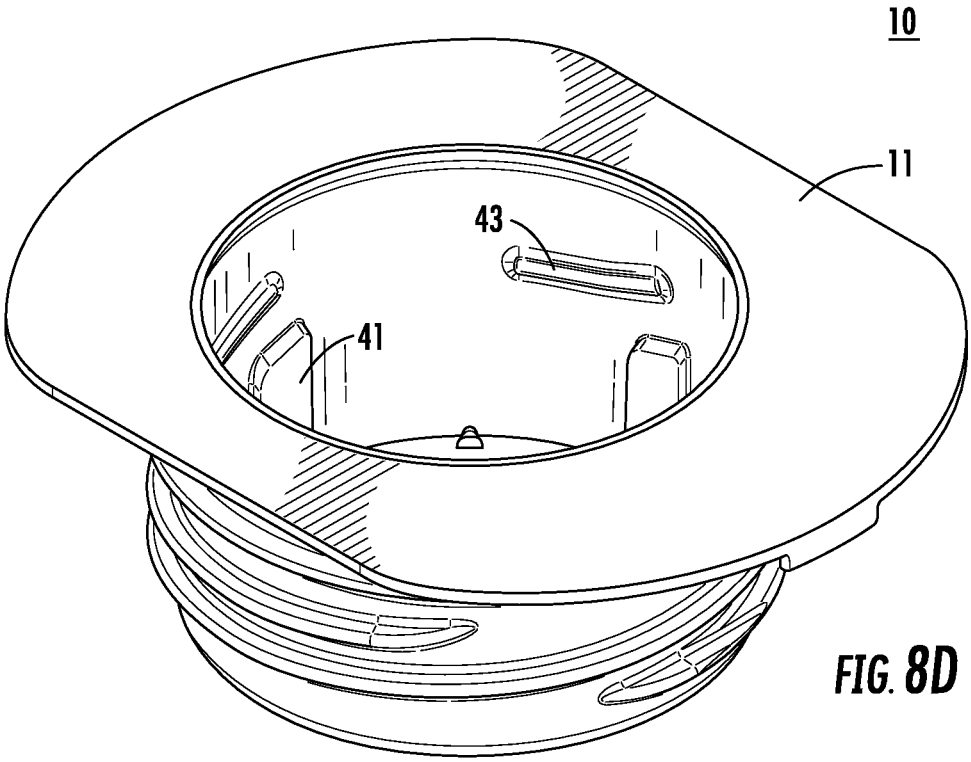
FIG. 8D is a bottom perspective view of the base of FIG. 8A.
Figure 8E:
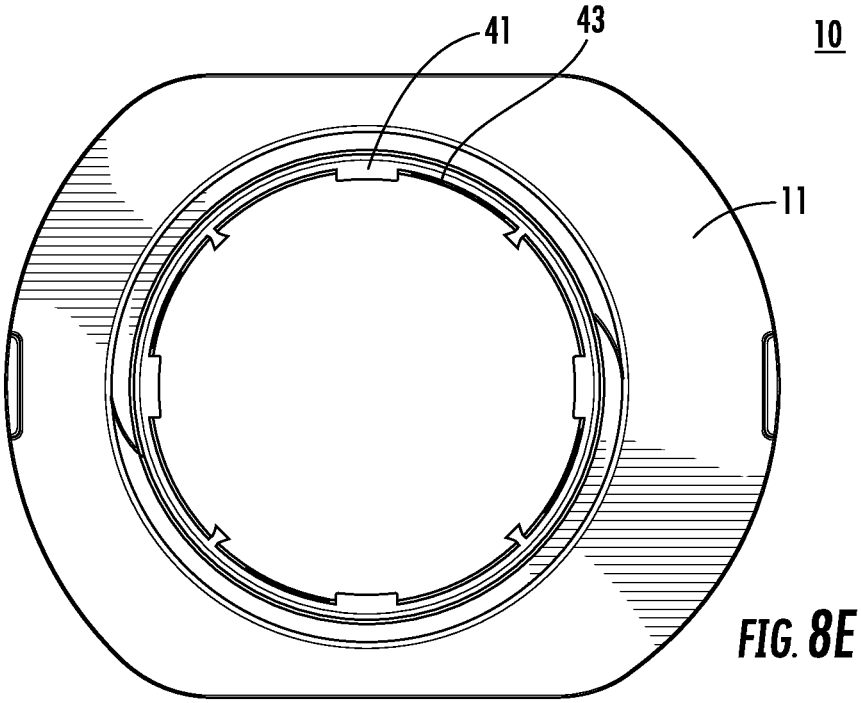
FIG. 8E is a top view of the base of FIG. 8A.
Figure 8F:
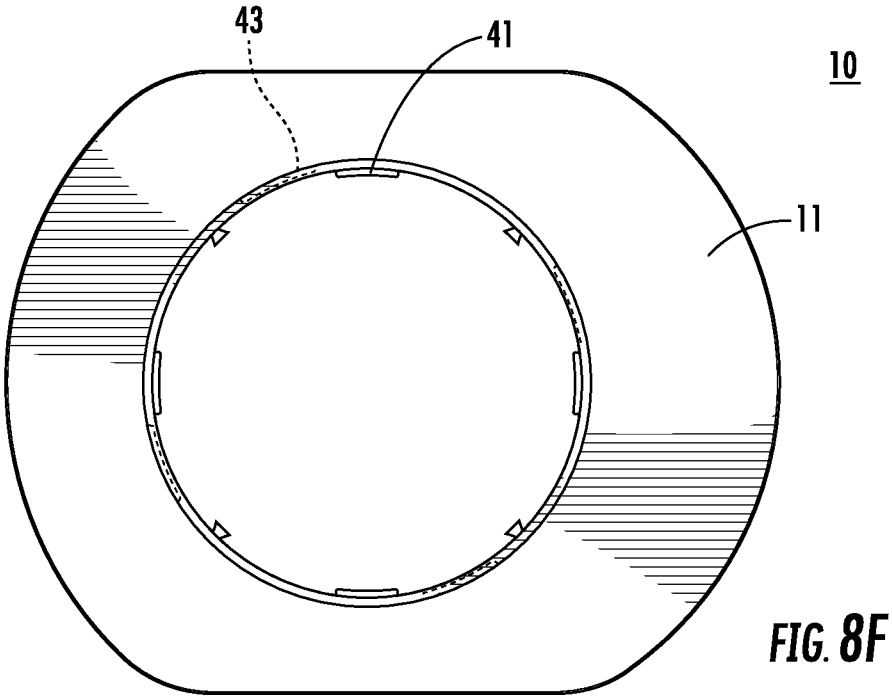
FIG. 8F is a bottom view of the base of FIG. 8A.

Referring to FIG. 7B, as the cap 30 is rotated in a counterclockwise direction relative to base 10, the tabs 35 of the cap 30 are moved into the spaces defined between the inner surface of the body 28 of the cutter 20 and the clockwise facing surfaces 26*b* of fins 26. As the cap 30 continues to be rotated in the counterclockwise direction, the tabs 35 come into engagement with the engagement surfaces 27 defined by the fins 26 and the inner surface of the body 28 of the cutter 20. This interaction between tabs 35 and the fins 26 causes the counterclockwise rotational movement of the cap 30 to be transmitted to the cutter 20.

As a result of the rotational force of the cap 30 being transmitted to the cutter 20 via the engagement of the tabs 35 and fins 26, the cutter 20 is rotated in a counterclockwise direction relative to base 10. This counterclockwise rotation of the cutter 20 results in the ribs 23 of the cutter 20 being moved along the bottom guide 43 and into the track 44 defined between the upper surface of the downward angled portion of bottom guide 43 and the lower surface of the helical guide 42. Once the ribs 23 have entered into the track 44, the continued rotation of the cap 30 results in the downward rotational movement of the cutter 20 relative to the base 10 at an angle defined generally by the angle of the track 44.

As the cutter 20 moves downwards, the teeth 29 of the blade forming the cutting element 21 are brought into engagement with and pierce through the portion of the container. Following the initial piercing/puncturing of the container upon the initial engagement of the cutting element 21 with the container, the continued downward rotational movement of the cutter 20 causes the cutting element 21 to create a larger circular opening in the container that provides access to the contents of the container.

The cutter 20 continues to rotate and move downwards in response to the initial counterclockwise movement of the cap 30 until the bottom end surfaces 25 of ribs 23 reach the annular bead 17 formed about the lower end of the opening 14 of the base 10, at which point the smaller diameter of the annular bead 17 relative to the outer diameter of the ribs 23 prevents further downwards movement of the cutter 20 relative to the base 10.

Referring to FIG. 3B, once cutter 20 has been rotated such that the bottom end surfaces of the ribs 23 are in engagement with the annular bead 17, upward axial movement of the cutter 20 relative to the base 10 is prevented by the configuration of the radially inwardly extending guide elements 40. Accordingly, following the initial travel of the cutter 20 to the post-initial opening configuration illustrated in FIG. 2, the cutter 20 remains stationary (both axially and rotationally) relative to the base 10 during subsequent application and removal of the cap 30 to the base 10 during subsequent closing and opening of the container.

In the embodiment of closure assembly 100 of FIGS. 1, 2, and 7, the movement of the cutter into the post-initial assembled configuration results in an opening being created in the container defined by a cut extending approximately 300° about the opening. As noted previously, the extent to which the container is cut can be configured by varying, among other features, the arrangement, number, spacing, etc. of the cutting elements 21. Additionally, the configuration of the cutter ribs 23 and/or the guide elements 40 of base 30 (e.g. length, pitch, etc.) can be configured to limit the degree of rotation of the cutter 20 as the cutter is moved downward in an axial direction, and in turn the degree to which a cut will be formed in the container during initial removal of the cap 30.

The base 10, cutter 20, and cap 30 portions of the closure assembly 100 can be assembled in any number of ways to form the pre-initial opening assembled configuration of closure assembly 100, such as e.g. illustrated in FIGS. 1A and 1B. In some embodiments, the base 10, cutter 20 and cap 30 can be molded or otherwise formed and provided as separate, individual components that are subsequently assembled together to form the pre-initial opening configuration of closure assembly 100. In other embodiments, any combination of the base 10, cutter 20, and cap 30 can be formed or molded as integral and/or monolithic structures, which are subsequently separated and assembled to form closure assembly 100.

Figure 6A:
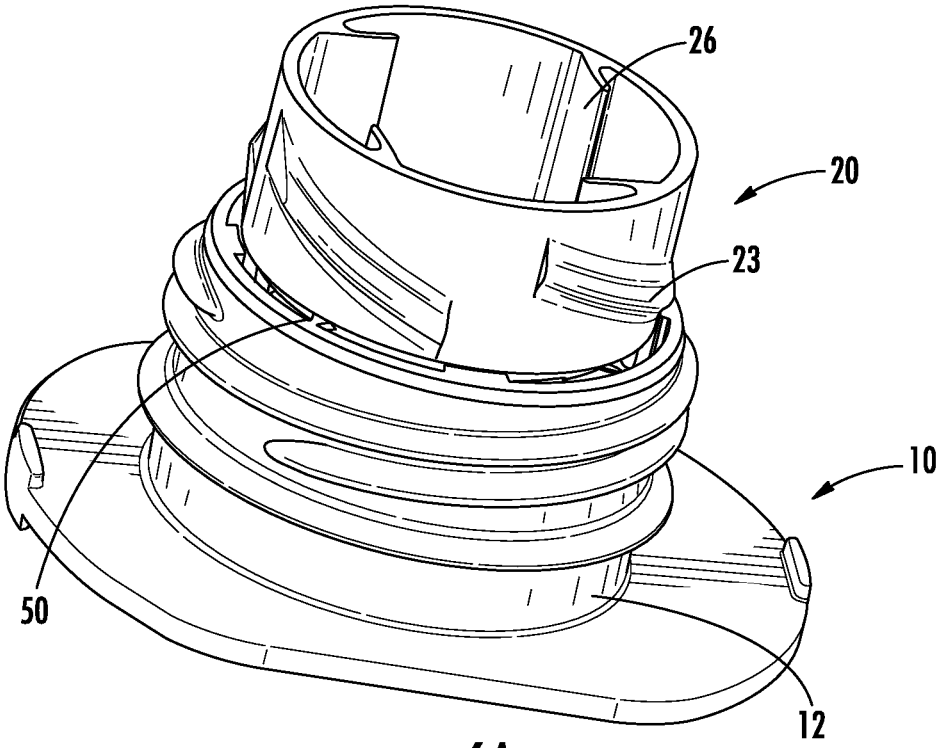
FIG. 6A is a perspective view of the cutter and base of the closure of FIG. 1A in a co-molded arrangement according to one embodiment.
Figure 6B:
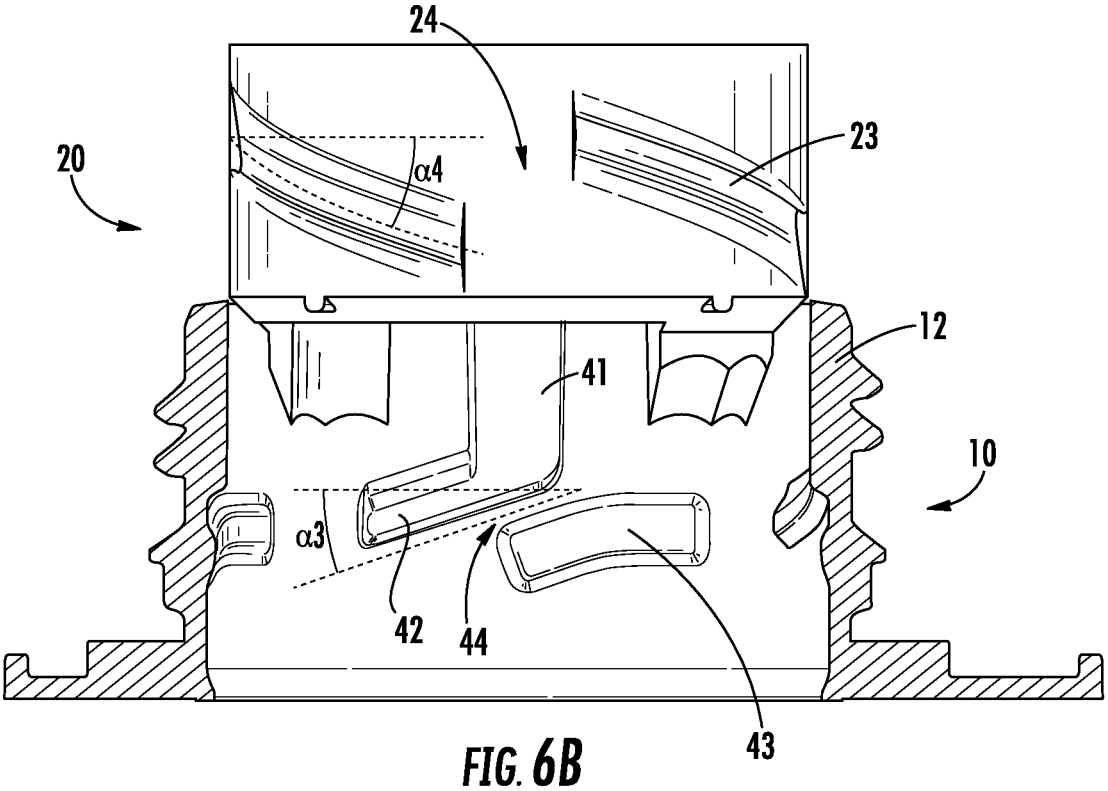
FIG. 6B is a is a side view of the cutter and a cross-sectional view of the base of the co-molded arrangement of FIG. 6A.

As shown, e.g. by the exemplary embodiment of FIGS. 6A and 6B, in some embodiments base 10 and cutter 20 may be molded as a single, unitary and optionally monolithic piece. In this molded base 10/cutter 20 configuration shown in FIGS. 6A and 6B, one or more frangible bridges 50 initially connect a portion of cutter 20 (such as, e.g. along bottom rim 22) to a portion of base 10. Although in the embodiment of FIGS. 6A and 6B the lower portion of cutter 20 is shown as being molded above and attached to an upper portion of base 10, in other embodiments an upper portion of cutter 20 can be molded below and attached to a lower portion of base 10. In other embodiments, cutter 20 can be molded radially inwards and partially or entirely within base, and cutter 20 and base 10 can be attached via frangible bridges 50 along the top, bottom, and/or top and bottom portions of base 10 and/or cutter 20.

By molding the base 10 and cutter 20 as a single unit, such as shown, e.g. in the embodiment of FIGS. 6A and 6B, production costs and time involved in forming and assembling the base 10 and cutter 20 can be minimized. Furthermore, in embodiments in which the base 10 and cutter 20 are molded such that the cutting element 21 is located above the lowermost portion of the opening 14 of the base 10, such as e.g. illustrated in FIGS. 6A and 6B, damage to the cutting element 21 that may occur during assembly of the cutter 20 into the base 10 may be minimized or prevented. Specifically, in such embodiments, the cutting elements 21 are located within the neck 12 of the base 10, and are thereby protected from damage that may otherwise occur in the event that, e.g. forces are applied to the top of the cutter 20 and/or bottom of the base 10 (such as, e.g. during assembly of the closure assembly 100.

As illustrated, e.g. by the embodiment of FIGS. 6A and 6B, in some embodiments where the cutter 20 and base 10 are molded as a single unit, the cutter 20 and base 10 may be formed such that cutter 20 is molded in a position relative to the base 10 that corresponds to a relative alignment of the base 10 and cutter 20 in the pre-initial opening configuration of the closure assembly 100. In such a manner, the assembly of the cutter 20 and base 10 may require only an axial movement (and no rotational movement) of the base 10 relative to the cutter 20, or vice versa.

For example, referring to the embodiment of FIGS. 6A and 6B, the cutter 20 and base 10 may be molded such that the one or more keyways 24 extending between adjacent ribs 23 of the cutter 20 are positioned directly above the one or more locator guides 41 formed on the inner surface of the neck 12 of base 10. Such an embodiment may allow for minimization of closure assembly 100 assembly time, as once the integrally molded cutter 20/base 10 assembly is ready to be assembled, all that is required is to provide an axial force sufficient to break the frangible bridges 50 between the cutter 20 and base 10 so as to properly position the cutter 20 within base 10. Once frangible bridges 50 have been broken, the alignment of the keyways 24 over the locator guides 43 allow the cutter 20 to be moved vertically downwards relative to base 10. Moreover, in addition to assisting in the alignment of the cutter 20 relative to the base 10 prior to assembly, the locator guides 43 are also configured to guide the cutter 20 axially downwards and prevent rotation of the cutter 20 during assembly of the cutter 20 into the base 10.

Furthermore, in embodiments such as e.g. that shown in FIGS. 6A and 6B, where there is no annular bead formed about the upper, inner surface of the neck 122, once the frangible bridges 50 have been broken, no additional force is required to position cutter 20 within base 10, as there is no mechanical interference that would prevent the axially downward movement of the cutter 20 relative to the base 10 As there is no need to push/snap the ribs 23 past any smaller diameter structures in order to position cutter 20 within base 10, assembling the cutter 20 within base 10 can be accomplished without encountering any resistance to the vertically downward movement of the cutter 20 relative to the base 10.

In embodiments in which the base 10 and cutter 20 are integrally molded and the cutter 20 is not molded within the base 10 (i.e. the cutter 20 extends above or below the base 10 in the molded configuration), the assembly of the cutter 20 into the base 10 may occur before, during or after assembly of the cap 30 onto the base 10. Additionally, the assembly of the cutter 20 into the base 10 may result from the downwards movement of the cutter 20 relative to the base 10, the base upwards relative to the cutter 20, and/or the movement of both the cutter 20 and base 10 relative to one another.

Referring again to the cutter 20 and base 10 embodiment of FIGS. 6A and 6B, in some embodiments, the cutter 20 may be pushed into base 10 prior to application of the cap 30 to the base 10 during assembly of closure assembly 100. Alternatively or additionally, the cutter 20 may be pushed into base 10 to assemble closure assembly 100 as a result of the application of the cap 30 to the base 10 during assembly of closure assembly 100.

Specifically, following molding of the monolithic cutter 20 and base 10 assembly illustrated in FIGS. 6A and 6B, cap 30 may positioned over the top end of cutter 20 to complete the assembly of the closure assembly 100. The cap 30 is moved downwards relative to the base 10, either by pushing the cap 30 downwards or by raising the base 10 upwards. As a result of the downward movement of the cap 30 relative to the base 10, the lower surface of the top panel 34 of the cap 30 comes into contact with the upper end of cutter 20, following which further downward movement of the cap 30 causes the frangible bridges 50 between cutter 20 and base 10 to break. As the cap 30 continues to move downward following the breaking of the bridges 50, the continued downwards movement of the cap 30 relative to base 10 causes the cutter 20 to be moved with the cap 30 in a downwards direction relative to the base 10.

Once the cap 30 has moved sufficiently downwards relative to the base 10 such that the thread 31 of the cap 30 engages the thread 15 of the base 10, the cap 30 is then screwed onto the base 10 (either by rotation of the cap 30 relative the base 10, rotation of the base 10 relative to the cap 30 or both) to complete the assembly of the closure assembly 100. The upper surface of bottom guide 43 may act as a stop which engages with the ribs 23 to allow the cutter 20 to be properly aligned at a desired axial position upon assembly of the cutter 20 and base 10 elements.

As illustrated in FIG. 7A, because of the elastic and/or resilient nature of the fins 26, as the cap 30 is screwed onto neck 12 of base 10, the drive tabs 35 are able to deflect and click over the fins 26, allowing the cap 30 to be rotated relative to the base 10 without causing a resultant rotation of the cutter 20 relative to the base 10 during this assembly step.

In some embodiments, as an alternative to and/or in addition to the fins 26 being resilient and flexible, the tabs 35 of the cap 30 may be flexible and elastic. In such embodiments, upon initial application of the cap 30 onto the neck 12 of the base 10, the tabs 35 are configured to deflect inwardly as the tabs 35 come into contact with the fins 26, allowing the tabs 35 to deflect and move over the fins 26 of the cutter 20 such that the cutter 20 remains stationary as the cap 30 is rotated relative to the base 10 during threading of the cap 30 onto the base 10. Upon passing over the fins 26, the tabs 35 generate an audible click as the radially inwardly deflected tabs 35 return to their initial, unstressed, generally perpendicularly downwardly extending configuration.

In order to further improve the ease with which the drive tabs 35 of the cap 30 may pass over fins 26 during initial application of the cap 30 onto the base 10 during assembly, the leading clockwise facing ends of drive tabs 35 may include a beveled surface 35*a*, as shown e.g. by the embodiment of cap 30 shown in FIG. 5A to allow the tabs 35 to more easily deflect and pass over fins 26 during assembly of closure assembly 100.

Because the drive tabs 35 of the cap 30 are able to deflect and pass over the fins 26 of cutter 20, the cap 30 does not need to be oriented or indexed prior to screwing the cap 30 to the base 10 during assembly of the closure assembly 100. This ability to screw cap 30 onto base 10 without indexing or orienting the cap 30 allows for easier, more reliable and faster assembly of the closure assembly 100 as compared to three-piece closures in which either the cap has to be indexed/oriented prior to assembly (adding to the time and cost of assembling closures) or in which the threaded cap is pushed or snapped onto the threaded base to apply the closure (which does not allow for a robust engagement between the cap and base once the closure is assembled).

Thus, the ability to assemble closure assembly 100 by screwing cap 30 onto base 10 without indexing or orienting the cap 30 beforehand provides for a robust engagement between the cap 30 and base 10 that can be quickly and easily effectuated. Moreover, the ability to apply to cap 30 without indexing or orienting also allows the cap 30 to be applied using a high-speed rotary assembler, which further decreases the time and costs associated with assembling closure assembly 100.

Referring to FIGS. 8A-8F, another embodiment of a base 10 that may be used to form closure assembly 100 is illustrated. As shown by FIGS. 8A-8F, the embodiment of base 10 of FIGS. 8A-8F share many similar features to the embodiment of base 10 illustrated in FIGS. 3A-3F. However, in contrast to the embodiment of base 10 of FIGS. 3A-3F, the guide elements 40 of the embodiment of base 10 of FIGS. 8A-8F are formed without a helical guide 42. Such an embodiment of base 10 as illustrated in FIGS. 8A-8F may be useful, e.g. where minimizing the materials used to form the base 10 may be desired for both weight and/or cost minimization considerations.

Figure 9A:
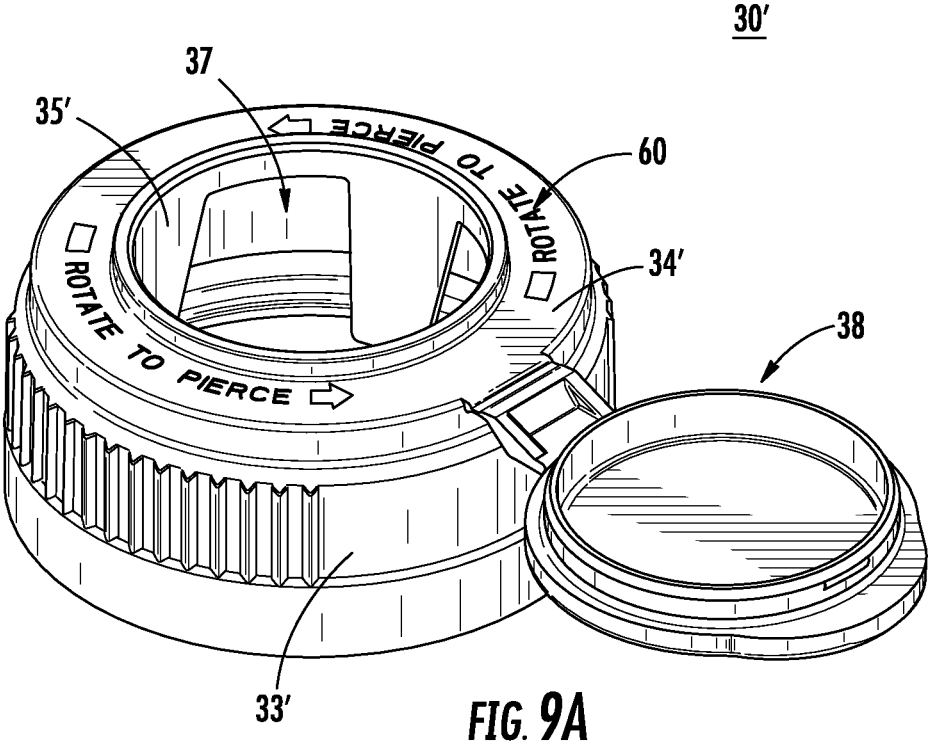
FIG. 9A is a top perspective view of a flip-top cap according to one embodiment.
Figure 9B:
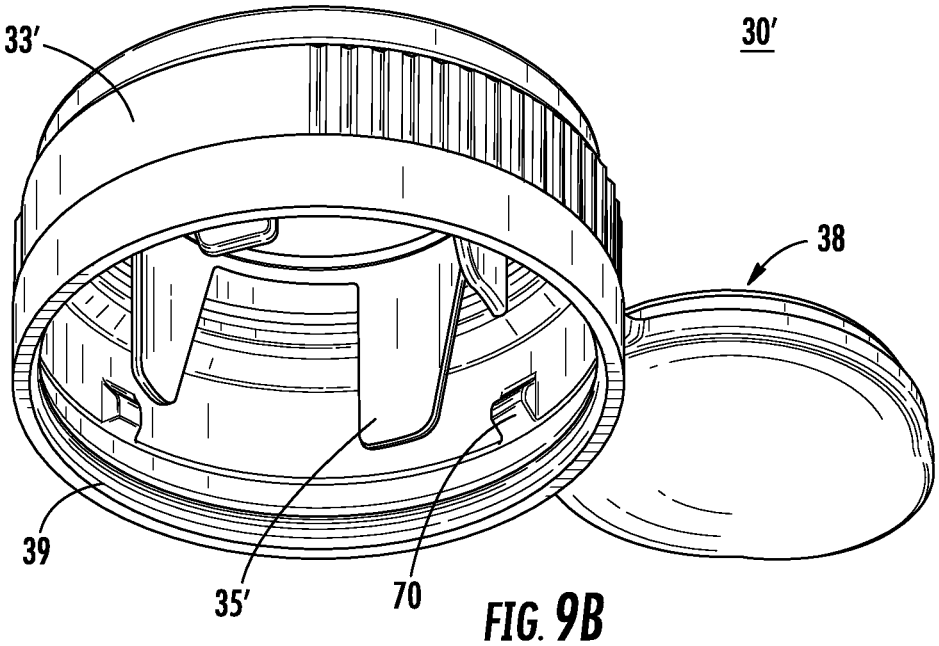
FIG. 9B is a bottom perspective view of the flip-top cap of FIG. 9A.
Figure 9C:
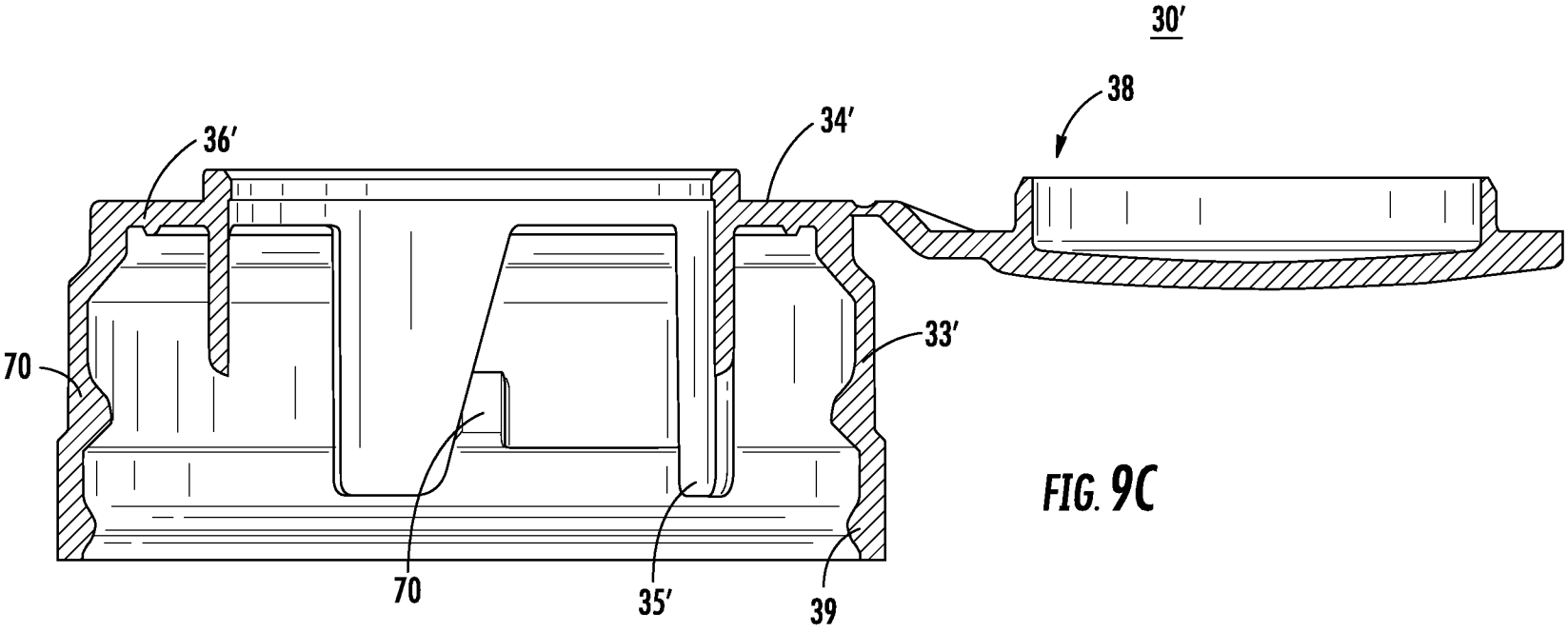
FIG. 9C is a side cross-sectional view of the flip-top cap of FIG. 9A.
Figure 9D:
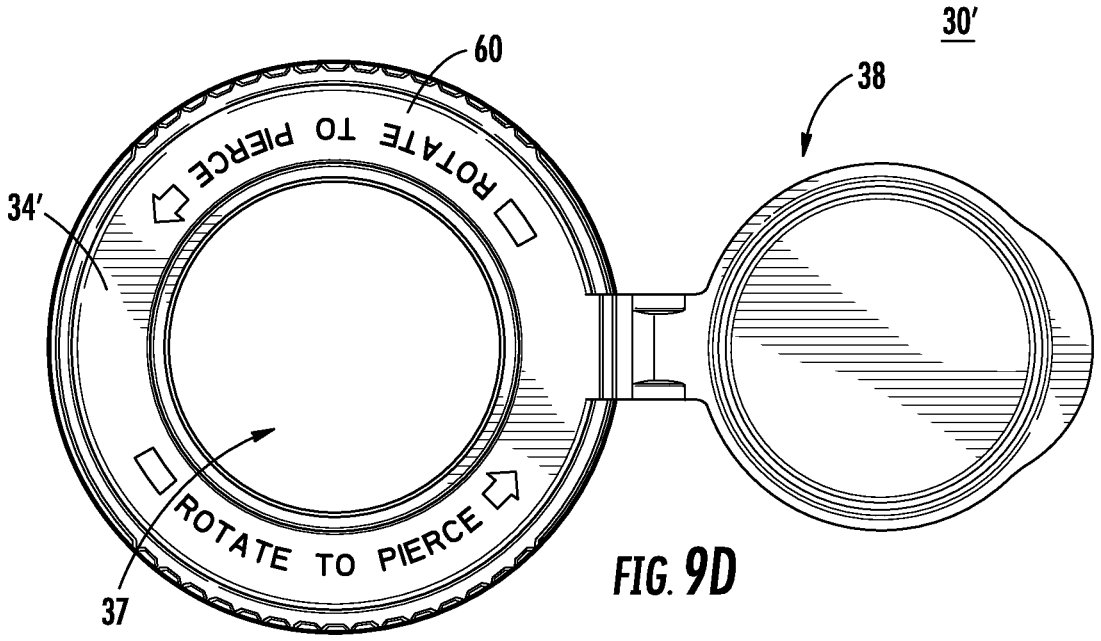
FIG. 9D is a top view of the flip-top cap of FIG. 9A.
Figure 9E:
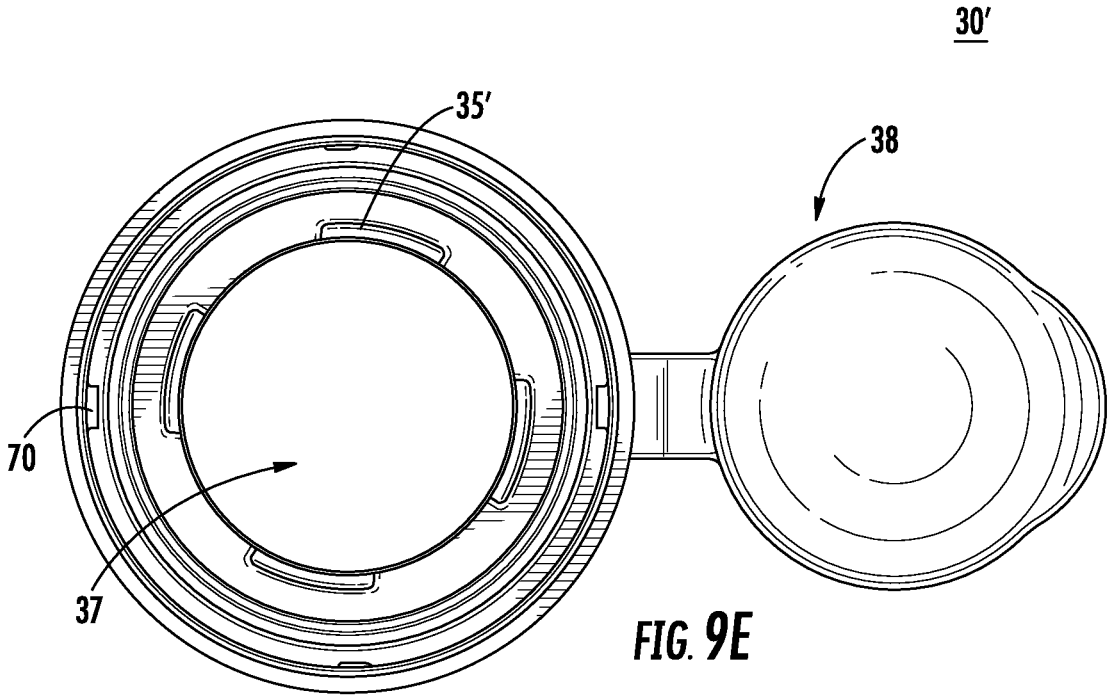
FIG. 9E is a bottom view of the flip-top cap of FIG. 9A.
Figure 10A:
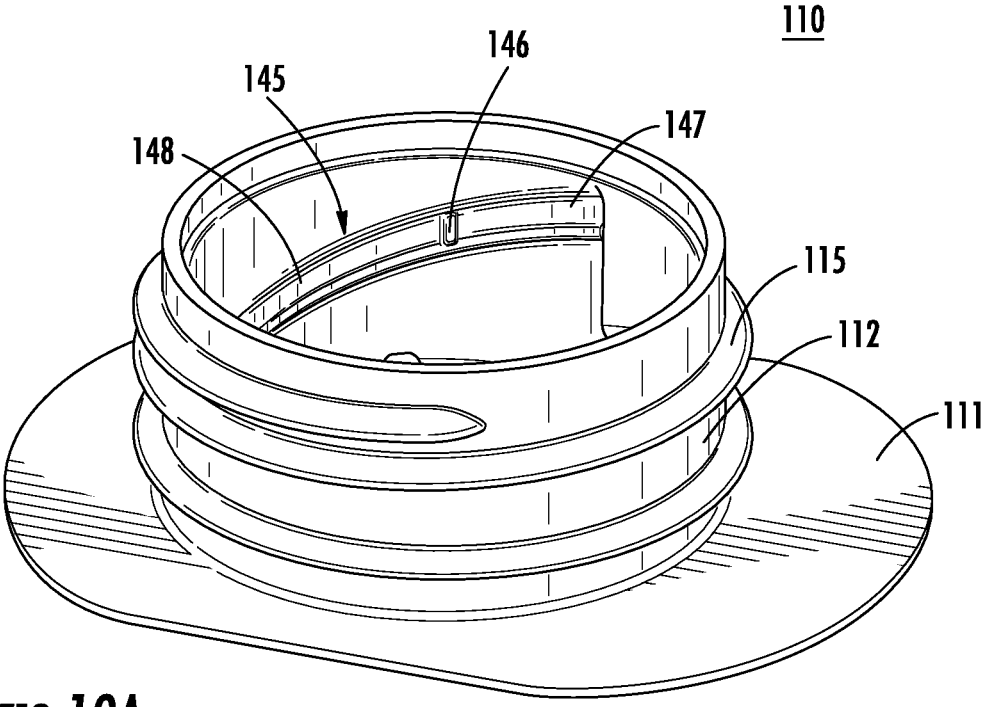
FIG. 10A is a top perspective view of a base according to one embodiment.
Figure 10B:
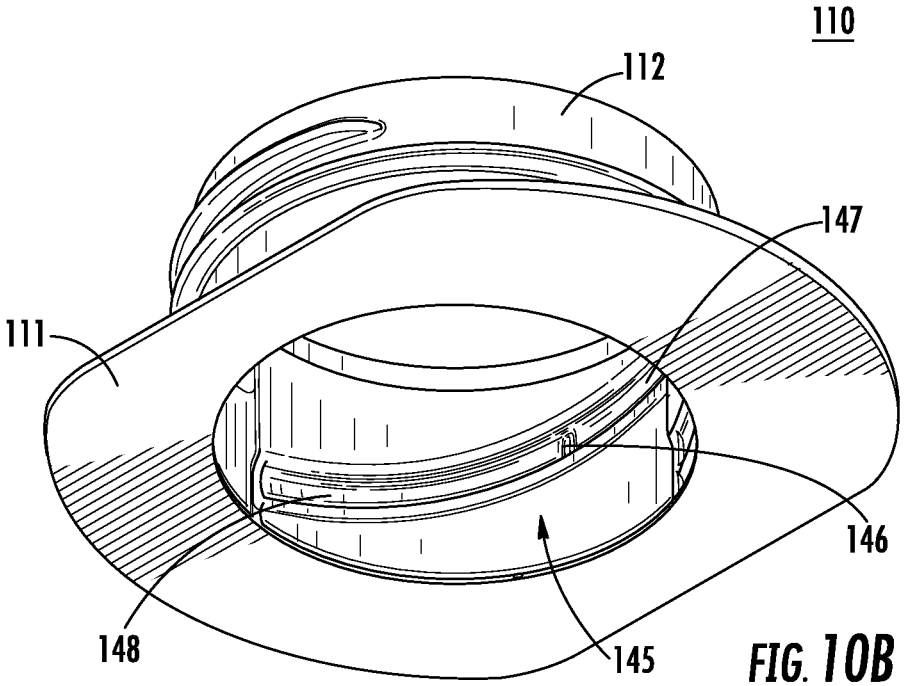
FIG. 10B is a bottom perspective view of the base of FIG. 10A.
Figure 10C:
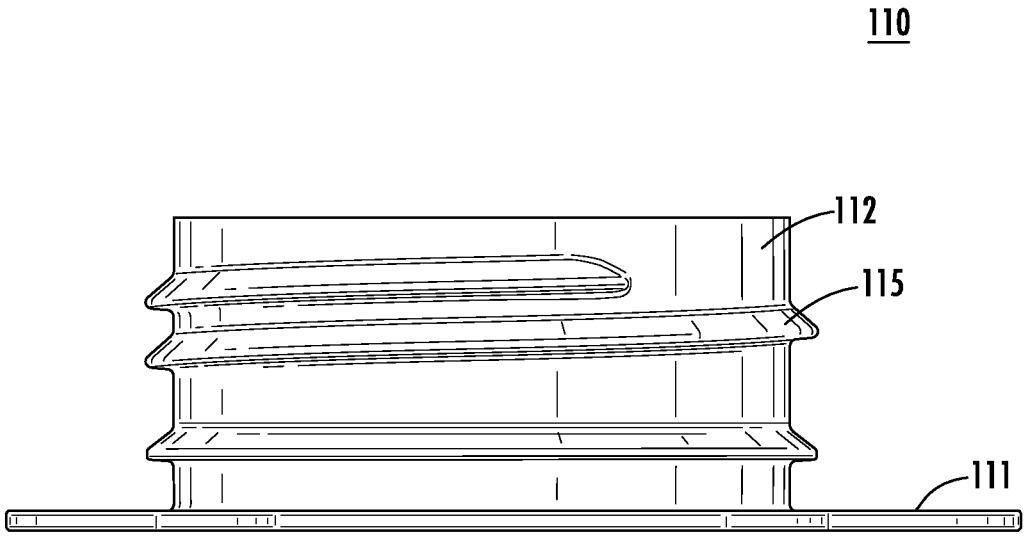
FIG. 10C is a side view of the base of FIG. 10A.
Figure 10D:
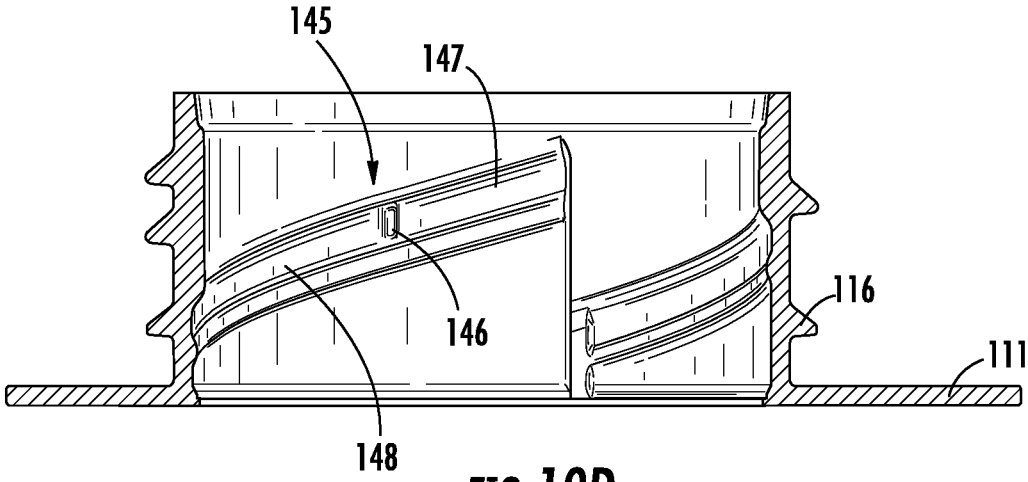
FIG. 10D is a cross-sectional view of the base of FIG. 10A.
Figure 10E:
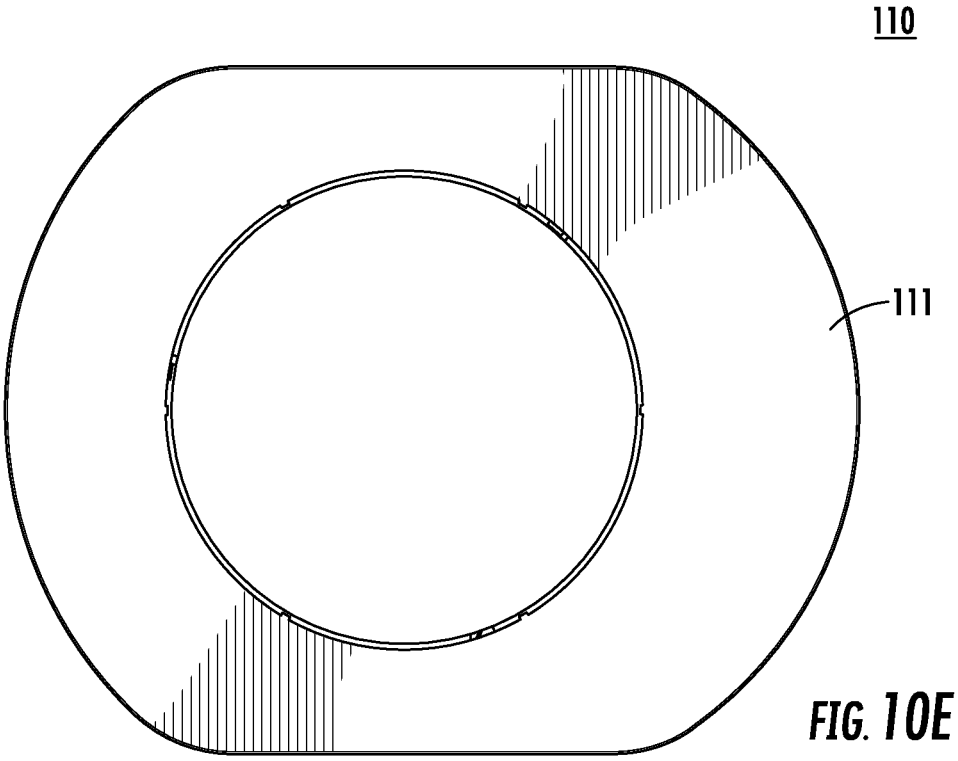
FIG. 10E is a bottom view of the base of FIG. 10A.
Figure 10F:
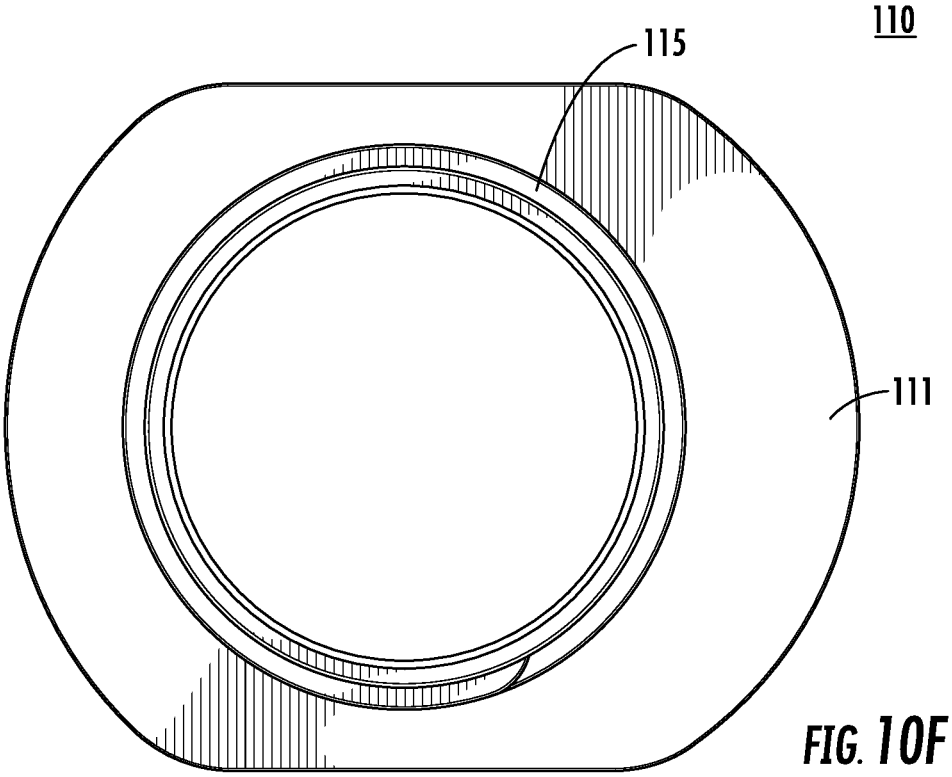
FIG. 10F is a top view of the base of FIG. 10A.
Figure 11A:
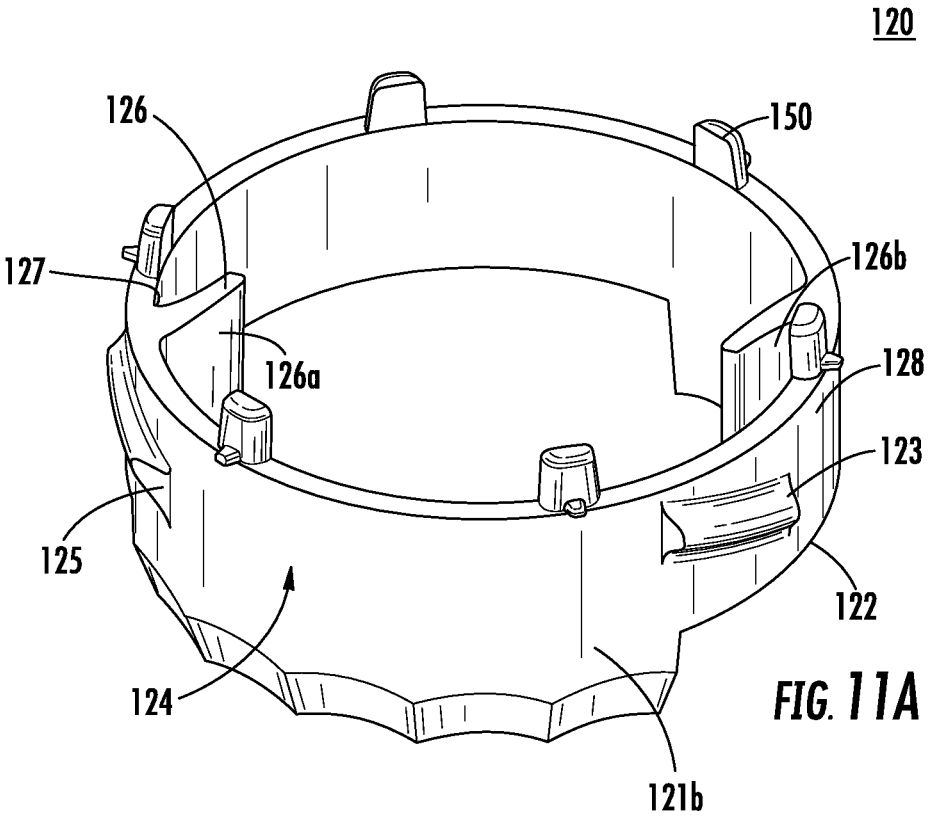
FIG. 11A is a top perspective view of a cutter according to one embodiment.
Figure 11B:
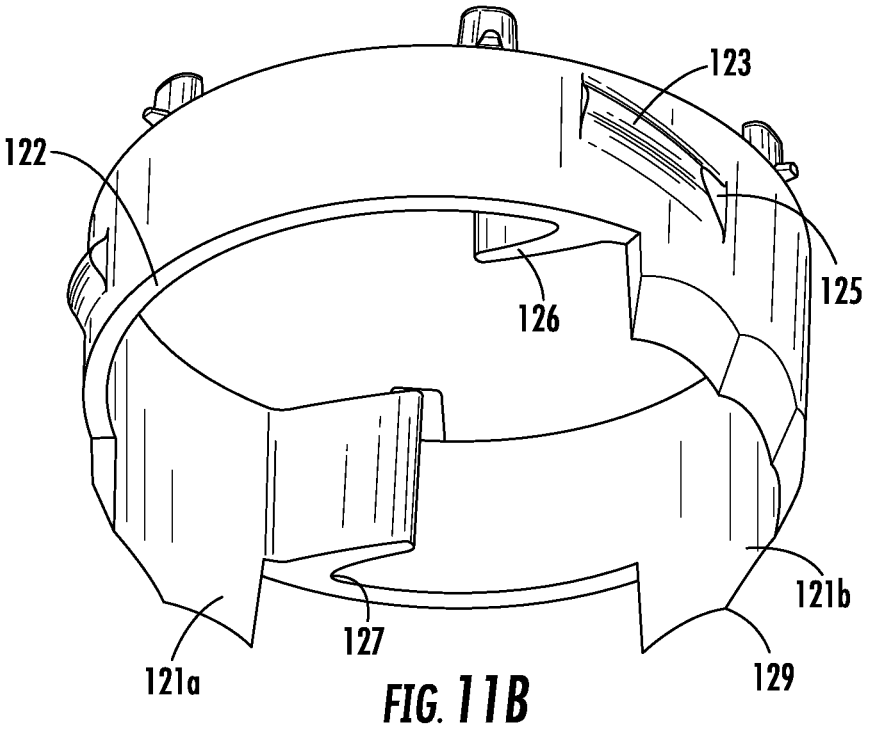
FIG. 11B is a bottom perspective view of the cutter of FIG. 11A.
Figure 11C:
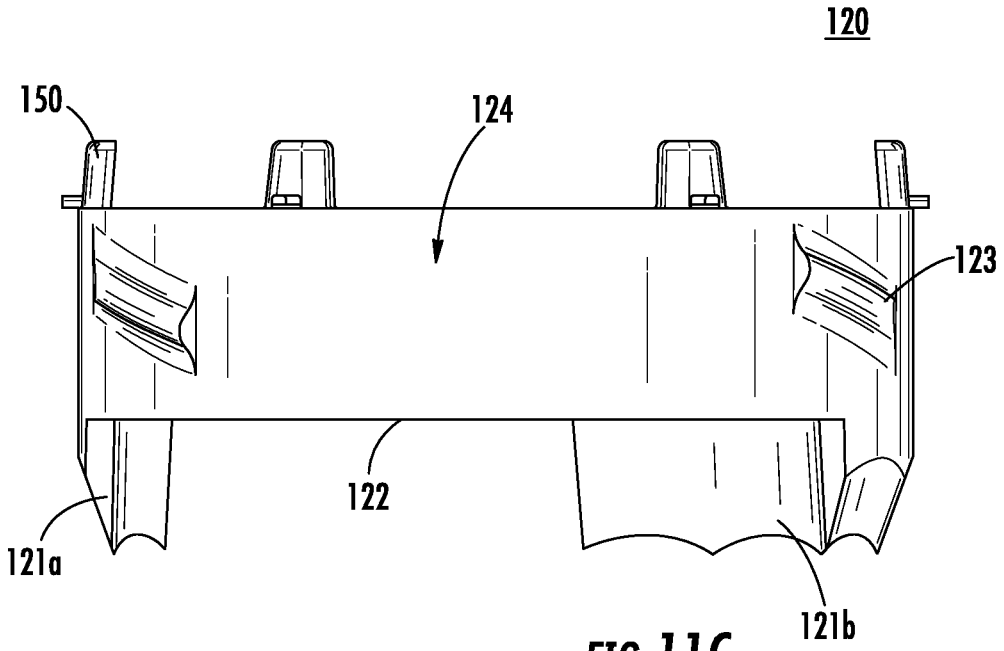
FIG. 11C is a side view of the cutter of FIG. 11A.
Figure 11D:
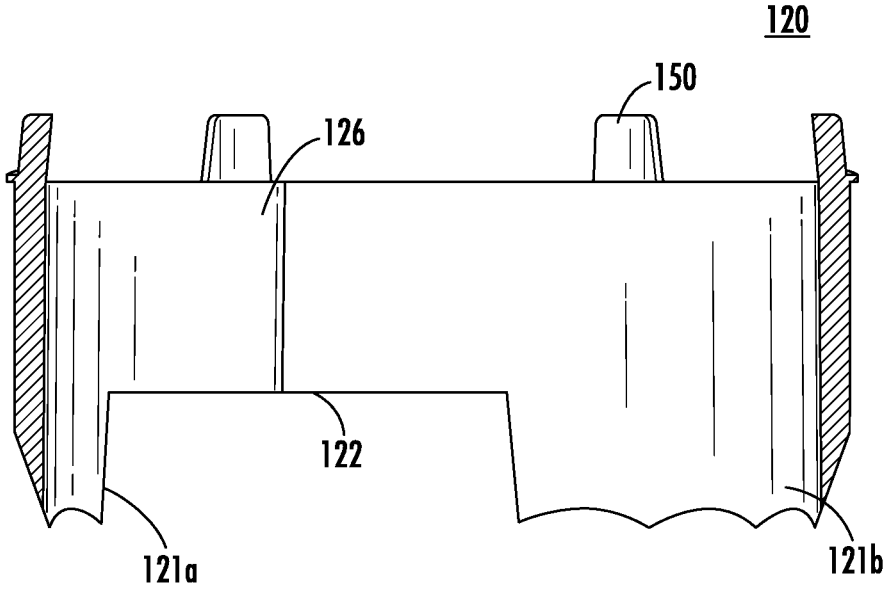
FIG. 11D is a cross-sectional view of the cutter of FIG. 11A.
Figure 11E:
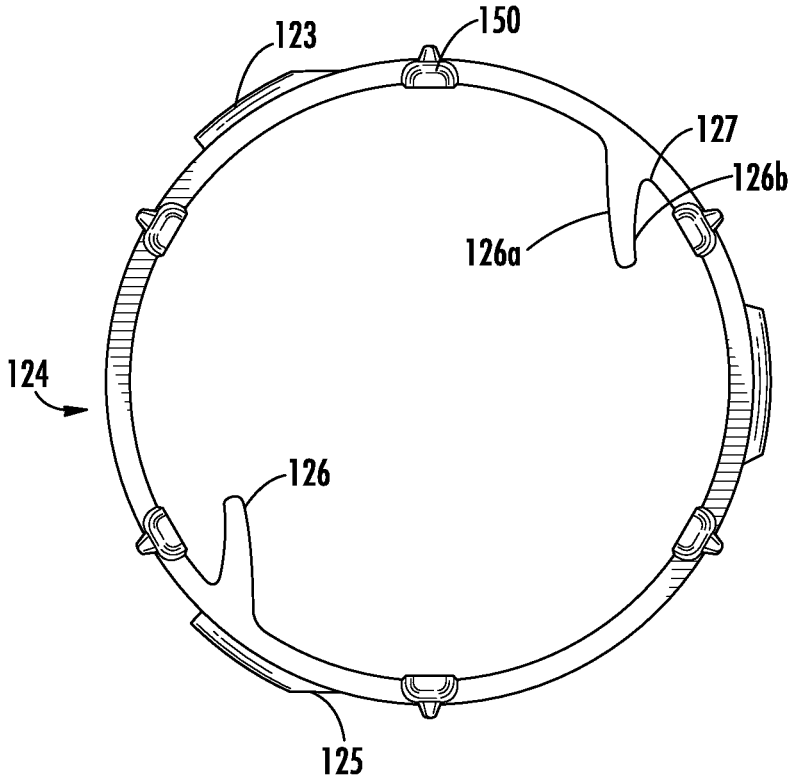
FIG. 11E is a top view of the cutter of FIG. 11A.
Figure 11F:
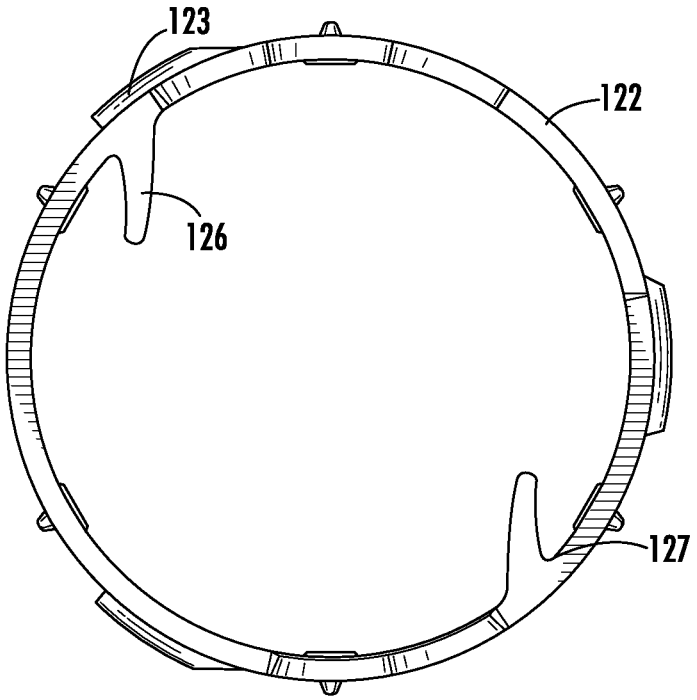
FIG. 11F is a bottom view of the cutter of FIG. 11A.

As illustrated in FIGS. 9A-9E, in some embodiments, cap 30 may be formed as a flip-top cap 30'. As shown in FIG. 9A, the top panel 34 of cap 30' may be formed about an opening 37 that extends from a top surface to a bottom surface of the top panel 34. Attached about a portion of the outer periphery of the cap 30' is a hinged cover 38 that is configured to fluidly seal the opening 37 when the cover 38 is in a closed position. Although not shown, in some embodiments, the opening 37 may initially be closed by a removable element, such as e.g. a ring pull-tab, foil, etc. that is removed prior to initial opening of the container.

Because the opening 37 of the flip-top cap 30' of FIGS. 9A-9E is configured to provide access to the contents of the container without requiring removal of the cap 30' from the closure, the flip-top cap 30' of FIGS. 9A-9E and the corresponding neck 12' of the base 10' (not shown) to which the flip-top cap 30' is to be attached may be formed without threads 15, 31. Instead, as illustrated e.g. by the flip-top cap 30' embodiment of FIGS. 9A-9E, the cap 30' may be formed with a retention member, such as e.g. annular bead 39, that is configured to snap-over, or otherwise engage a corresponding structure of the base 10' (not shown) to prevent the cap 30' from being removed from the base 10' once the cap 30' and base 10' are assembled.

Besides the difference in how the cap 30' is applied to the base 10' (e.g. a snap fit as compared to e.g. to the threaded base 10 and cap 30 of the embodiment of FIG. 1A) and that it may not be necessary for the tabs 35' of cap 30' to deflect over the fins 26' of cutter 20' during assembly of the closure assembly 100', in embodiments of closure assembly 100' incorporating a flip-top cap 30', the closure assembly 100' is assembled in a manner substantially the same as any such methods of assembling closure assembly 100 described with respect to embodiments of closure assembly 100 incorporating a threaded cap 30 and base 10 design.

Similarly, the general operation of a closure assembly 100' incorporating a flip-top cap 30' to effectuate piercing/puncturing/cutting of a container to which the closure assembly 100' is attached is similar to the operation of a closure assembly 100 incorporating a threaded cap 30 and base 10 design as e.g. described previously with respect to FIGS. 1 and 2. Specifically, similar to the operation of threaded cap 30 and base 10 closure assembly 100 embodiments described previously, counterclockwise rotation of the flip-top cap 30' relative to the base 10' results in the tabs 35' of cap 30' engaging the fins 26 of cutter 20, causing the cutter 20 to be translated rotationally downwards to create an opening in the container.

Because conventional flip top closures (i.e. formed without a cutter 20') do not typically require a user to rotate the flip-top closure with respect to the container in order to access the contents of the container, writing and/or symbols may be provided about the flip-top cap 30' to instruct the user to rotate the flip-top cap 30' relative to the base 10' to effectuate the initial formation of the opening into the container to allow for access to the container contents. As illustrated in FIG. 9A, in one embodiment, the instructions may be provided in the form of markings 60 located about a portion of the top panel 34' of cap 30'.

Once the flip-top cap 30' has been initially rotated relative to the base 10' so as to effectuate the creation of an opening into the container, it may be desired to prevent or minimize any subsequent rotation of the flip-top cap 30' relative to the base 10'. Accordingly, in some embodiments of a closure assembly 100' having a flip-top 30' such as e.g. illustrated in FIGS. 9A-9E, the cap 30' may be provided with one or more lugs 70 extending radially inwards from the inner surface of the skirt 33'. The lugs 70 may be configured to engage with one or more abutment or stop features (not shown) formed about the neck 12' of the base 10' such that following the initial rotation of the cap 30' to effectuate the creation of an opening in the container, further rotation of the cap 30' relative to the base 10' is prevented.

Illustrated in FIGS. 10A-10F is another embodiment of a base 110 that may be used to form closure assembly 100. The embodiment of base 110 shown in FIGS. 10A-10E is similar to the embodiment of base shown in FIGS. 3A-3F. However, instead of the radially inwardly extending guide elements 40 formed on the inner surface of the neck 12 of the base 10 of FIGS. 3A-3F, the guide elements 140 of base 110 may compromise one or more downwardly angled helical grooves 145 formed within and extending into the neck 112 of the base 110. Located along the grooves 145 and extending radially inwards from the inner surface of the neck 112 defining grooves 145 are on or more abutment element 146.

Shown in FIGS. 11A-11F is one embodiment of a cutter 120 that may, e.g. be used with a base 110 embodiment as illustrated in FIGS. 10A-10F to form closure assembly 100. Similar to the cutter 20 embodiment as illustrated in FIGS. 4A-4F, the cutter 120 of FIGS. 11A-11F may comprise a first set 121*a* and a second set 121*b* of cutting elements 121. The cutter 120 may also comprise one or more outwardly extending ribs 123 formed about the outer surface of the body 128 of the cutter 120. Additionally, one or more fins 126 extend radially inwards from the inner surface of the body 128 of cutter 120.

However, as compared to the cutter 20 embodiment of FIGS. 4A-4F, the height of the body 128 of the cutter 120 of the embodiment of FIGS. 11A-11F is shorter, as are the ribs 123 that are formed about the exterior surface of the body 128 of the cutter 120 as compared to the ribs 23 of cutter 20.

Figure 12A:
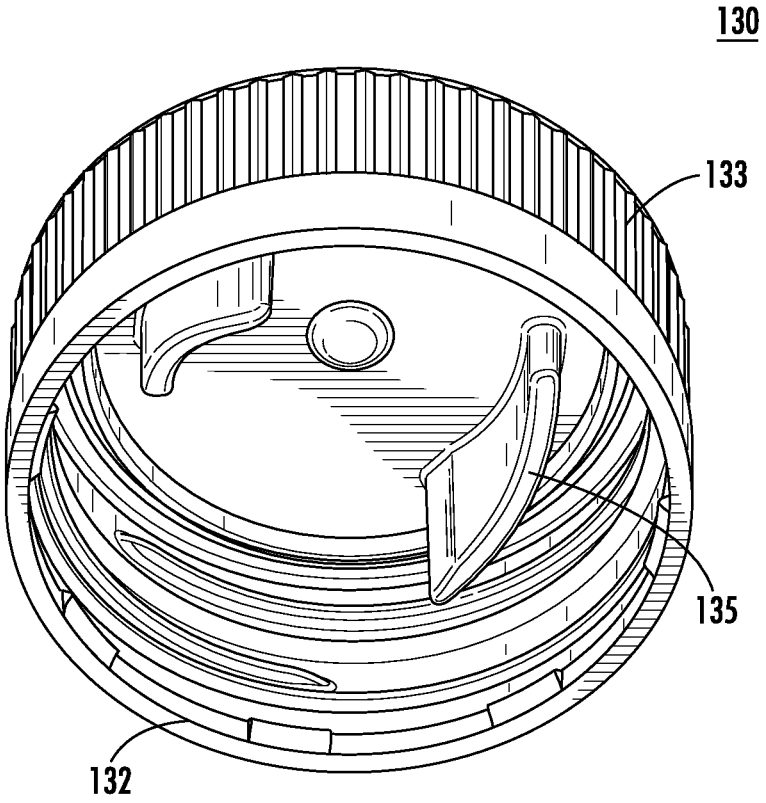
FIG. 12A is a bottom perspective view of a cap according to one embodiment.
Figure 12B:
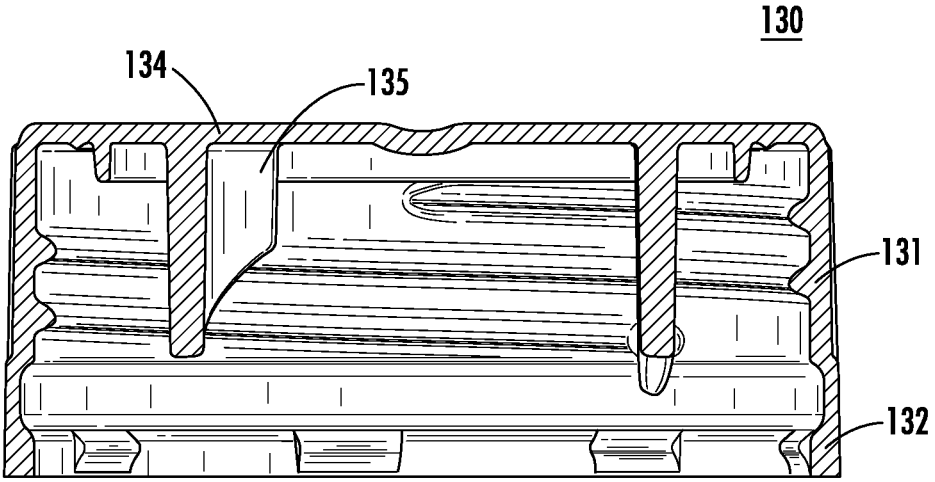
FIG. 12B is a cross-sectional view of the cap of FIG. 12A.

Referring to FIGS. 12A and 12B, one embodiment of a cap 130 is shown. The cap 130 of the embodiment of FIGS. 12A and 12B is similar to the cap 30 embodiment discussed with respect to FIGS. 5A and 5B, expect the arrangement of the drive tabs 135 of cap 130 is varied from that of the cap 30 of FIGS. 5A and 5B.

In one embodiment, the base 110 of FIGS. 10A-10F, the cutter 120 of FIGS. 11A-11F and the cap 130 of FIGS. 12A and 12B may be used together to form closure assembly 100. The resultant closure assembly 100 operates in a manner substantially similar to the closure described with reference, e.g. to FIGS. 1, 2 and 7 above, with the primary difference in the closure embodiment 100 formed having base 110, cutter 120 and cap 130 being in the engagement of the ribs 123 of the cutter 120 with the guide elements 140 of base 110 during initial opening of the closure assembly 100.

Specifically, the lengths of the ribs 123 of the cutter 120 generally correspond to and are preferably no longer than the upper portion 147 of the helical grooves 145 extending between the abutment element 146 and the upper end of each groove 145 formed in the base 110 embodiment of FIGS. 10A-10F. Upon assembly of the closure assembly 100, the ribs 123 of the cutter 120 are positioned within these upper portions 147 of the grooves 145 of base 110.

The abutment elements 146 prevent the cutter 120 from inadvertently being moved downwards relative to the base 110 prior to initial removal of the cap 130 from the base 110. Upon initial removal of the cap 130, the rotational removal of the cap 130 from the base 110 provides sufficient force for the ribs 123 to overcome the engagement with the abutment elements 146, and the ribs 123 are guided rotationally downwards within the lower portions 148 of the grooves as the cap 130 continues to move rotationally upwards along the threads 115 of base 110.

Figure 13A:
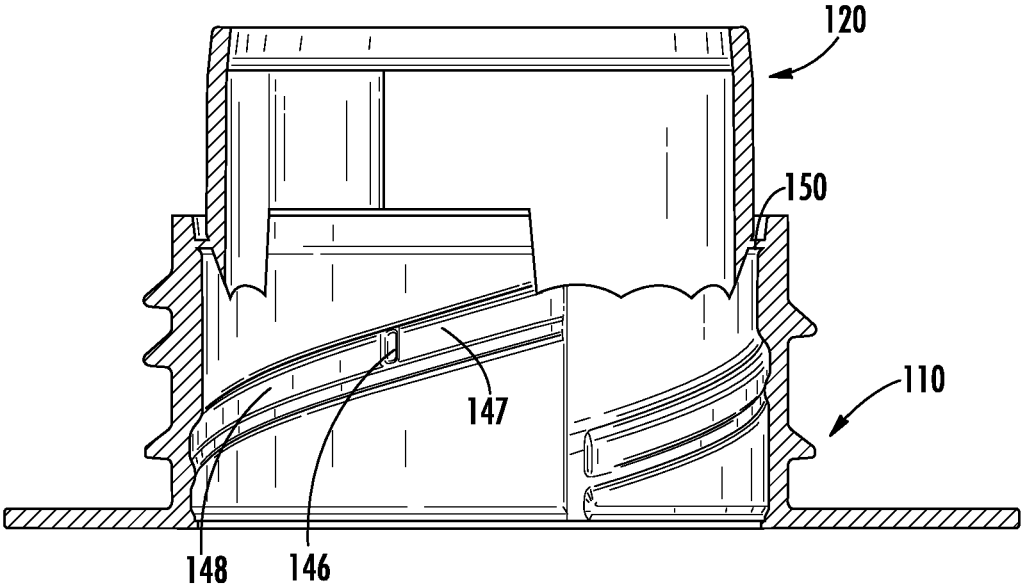
FIG. 13A is a cross-sectional view of the base of FIG. 10A and the cutter of FIG. 11A in a co-molded arrangement according to one embodiment.
Figure 13B:
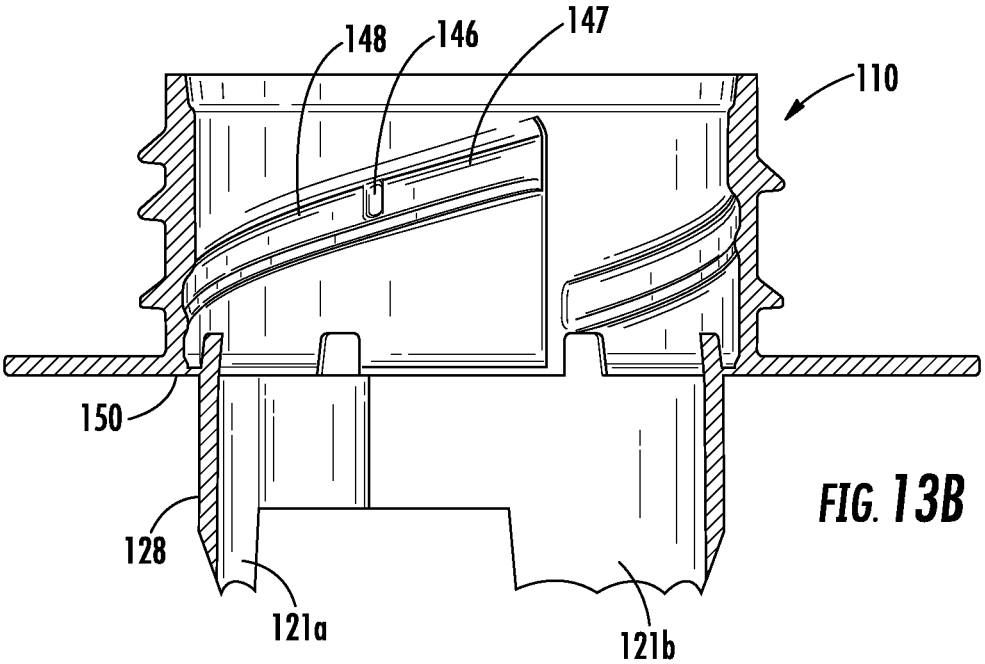
FIG. 13B is a cross-sectional view of the base of FIG. 10A and the cutter of FIG. 11A in a co-molded arrangement according to one embodiment.
Figure 14A:
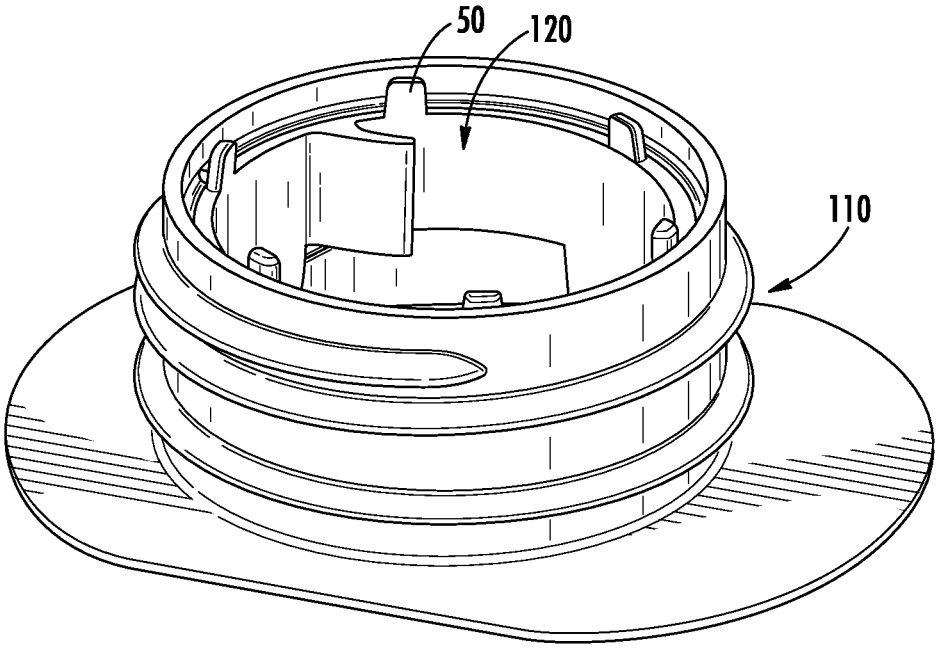
FIG. 14A is a top perspective view of the cutter of FIG. 11A arranged within the base of FIG. 10A according to one embodiment.
Figure 14B:
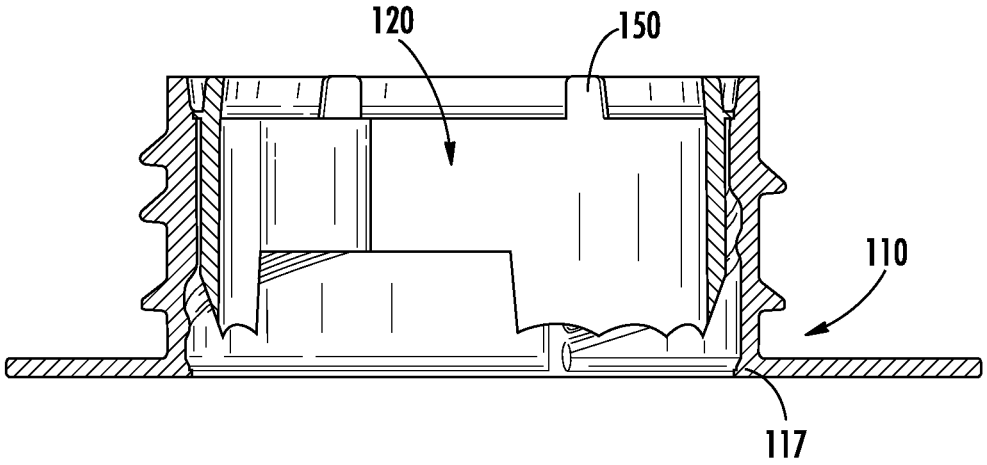
FIG. 14B is a cross-sectional view of the cutter and base arrangement of FIG. 14A.

Illustrated in FIGS. 13A and 13B are two embodiments of molding arrangements that may be used to form the base 110 and cutter 120. As illustrated in FIG. 13A, in one embodiment the cutter 120 may be molded and attached above the base 110, with frangible bridges 150 connecting a lower portion of the cutter 120 to an upper portion of the base 110. Alternatively, as illustrated in FIG. 13B, in other embodiments the cutter 120 may be molded and attached below the base 110, with frangible bridges 150 connecting an upper portion of the cutter 120 to a lower portion of the base 110. Referring to FIGS. 13A and 13B, once the cutter 120/base 110 assembly has been molded, the cutter 120 is positioned within base 110 in an arrangement as illustrated e.g. in FIGS. 14A and 14B.

As illustrated in FIGS. 13A and 13B, the inner diameter of the neck 112 of the base 110 is slightly smaller than the outermost diameter of the ribs 123 of the cutter 120. Additionally, located about the bottom of neck 117 is an annular bead 117 also having a diameter that is smaller than the outermost diameter of the ribs 123. Accordingly, in addition to requiring force to break the frangible bridges 150 connecting the base 110 and cutter 120, force is also required to push or snap the ribs 123 past the smaller diameter portions of the base 110 and into engagement with the upper portions 147 of the grooves 145 formed within the wall of neck 112 as illustrated, e.g. in FIGS. 14A and 14B.

In some embodiments of a co-molded base/cutter assembly, e.g. the molded arrangement illustrated in FIG. 13A, the positioning of the cutter 120 within base 110 may be accomplished prior to or after attachment of the cap 130 to the base 110. In other embodiments, such as, e.g. the molded arrangement of FIG. 13A, positioning of the cutter 120 within the base 110 may be effectuated by and occur during the step of attaching the cap 130 to the base 110, with the downward movement of the cap 130 relative to the base 110 during attachment of the cap 130 being used to break the frangible bridges 150 and push ribs 123 into engagement with the upper portions 147 of the grooves 145 formed within the wall of neck 112.

Positioning of the cutter 120 within base 110 for the molded arrangement illustrated in FIG. 13B may be accomplished in manners similar to those described with reference to FIG. 13A. Specifically, in some embodiments, positioning of the cutter 120 within the base 110 for the molded arrangement of FIG. 13B may occur prior to or after attachment of the cap 130 to the base 110.

In other embodiments, positioning of the cutter 120 within the base 110 for the molded arrangement of FIG. 13B may be effectuated by and occur during the step of attaching the cap 130 to the base 110. In one embodiment, the cap 130 may be moved downwards relative to the base 110 to attach the cap 130 to base 110. As the cap 130 moves downward and engages the upper surface of the base 130, the downward force imparted by the cap 130 onto the base 110 may provide a force sufficient to break the frangible bridges 150 and push ribs 123 past the annular bead 117 and past the smaller diameter portion of the neck 112 and into engagement with the upper portions 147 of the grooves formed within the wall of neck 112.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed is:

1. A closure for a container, the closure comprising:

a base comprising:

a mounting portion;

a neck portion centered and extending about a vertical axis;

a thread formed about an exterior surface of the neck; and a track formed along an interior surface of the neck, the track defined by:

a lower end of a vertical guide extending generally perpendicularly downwards from an upper portion of the neck; and an upper surface of a bottom guide extending below at least a portion of the lower end of the vertical guide;

a cutter comprising:

a cylindrical body;

a cutting element extending downwards from a lower end of the cylindrical body;

a downwardly angled rib extending about an outer surface of the cutter; and a fin extending radially inwards from an inner surface of the cylindrical body, wherein the fin terminates at an end opposite the inner surface of the cylindrical body;

a cap comprising:

a top panel;

a skirt extending downwards from an outer periphery of the top panel;

a thread configured to interact with the thread of the base to sealingly attach the cap to the base; and a drive tab extending downwards from a lower surface of the top panel;

wherein in an assembled, pre-initial opening configuration of the closure, the cutter is located within the neck portion of the base such the bottommost surface of the cutting element is located above a lowermost portion of the neck portion and the cap is sealingly attached to the base by an engagement of the thread of the cap with the thread of the base;

wherein upon initial removal of the cap from the base, rotation of the cap relative to the base results in the engagement of the drive tab with the fin, causing the cutter to be rotated relative to the base;

the rotation of the cutter relative to the base resulting in the rib entering into and traveling downwards along the track as the cap is rotated relative to the base, with the downward rotational movement of the cutter relative to the base causing the cutting element to move to a position in which the bottommost surface of the cutting element extends below the lowermost portion of the cap.

2. The closure of claim 1, wherein, in the assembled, pre-initial opening configuration of the closure, a bottommost surface of the rib of the cutter rests upon the upper surface of the bottom guide.

3. The closure of claim 1, further wherein, in the assembled, pre-initial opening configuration of the closure, an end engagement surface of the rib is located adjacent a first vertically extending end surface of the vertical guide.

4. The closure of claim 3, wherein the track is further defined by a helical guide extending along a downward angle from a second vertically extending end surface of the vertical guide.

5. The closure of claim 4, wherein the track is defined between a lower end of the helical guide and the upper surface of the bottom guide.

6. The closure of claim 1, wherein the tabs of the cap are configured to deflect in a radially inwards direction when the cap is attached to the base.

7. The closure of claim 1, wherein the rotation of the cap upon initial removal of the cap causes rotation of the cutter in the same direction as the direction of the rotation of the cap.

8. The closure of claim 1, wherein the base further comprises a retaining structure located about the lowermost portion of the interior surface of the neck portion.

9. The closure of claim 8, wherein the retaining structure is configured to engage a bottommost surface of the rib to prevent removal of the cutter through a bottom opening defininf the lowermost portion of the neck portion.

10. The method of claim 1, wherein the cutter rotates around a rotational axis, and wherein the portion of the fin closest to the rotational axis is the end of the fin.

11. A closure assembly for a container comprising:

a base comprising:

a mounting portion;

a neck portion centered and extending about a vertical axis;

a first guide element extending generally perpendicularly downwards along the interior surface of the neck from an upper portion of the neck, the first guide having a width as measured in an angular direction that defines a first distance;

a second guide element, at least a portion of the second guide being located below a lowermost surface of the first guide; and a track defined between the first guide element and the second guide element; and a cutter comprising:

a cylindrical body;

one or more cutting elements extending downwards from a lower end of the cylindrical body;

one or more fins extending radially inwards from an inner surface of the cylindrical body; and two or more downwardly angled ribs extending about an outer surface of the cylindrical body;

wherein the first end of a first rib is spaced apart a second distance as measured in an angular direction from a second end of a second rib located adjacent the first rib, the first distance being substantially the same as the second distance;

wherein in an assembled configuration of the cutter and base, the cutter is positioned within the neck of the base such that the first guide element is positioned in the space defined between the first end of the first rib and the second end of the second rib; and the first and second guide elements being arranged to define the track such that upon rotation of the cutter relative to the base, the cutter is moved rotationally downwards relative to the base as the ribs of the cutter travel along the track.

12. The closure assembly of claim 11, further comprising one or more frangible attachments initially connecting the base to the cutter; the one or more frangible attachments extending between an upper portion of the neck portion of the base and a lower portion of the cylindrical body of the cutter;

wherein the attachments are arranged between the base and the cutter to define a first base and cutter configuration in which the portion of the cutter defining the space between the first end of the first rib and the second end of the second rib extends directly above the portion of the base about which the first guide is formed.

13. The closure assembly of claim 12, wherein, following breaking of the attachments, the bottommost surfaces of ribs are configured to rest on top of the uppermost surface of the second guide element in a second base and cutter configuration.

14. The closure assembly of claim 13, wherein the base and cutter are configured such that the transition from the first configuration to the second configuration of the base and cutter may be effectuated by only an axial movement of the cutter relative to the base, without requiring any rotation of the cutter relative to the base.

15. The closure assembly of claim 14, further comprising a cap having a top panel, a skirt extending from an outer periphery of the top panel, and a thread extending about an interior surface of the skirt.

16. The closure assembly of claim 15, wherein the transition from the first configuration to the second configuration of the base and cutter is caused by the attachment of the cap to the base.

17. The closure assembly of claim 16, wherein the attachment of the cap to the base is achieved by threading the thread of the cap onto a thread extending about an outer surface of the neck portion of the base.

18. A method of assembling a closure for a container comprising:

providing a base comprising:

a mounting portion;

a neck portion centered and extending about a vertical axis;

a thread formed about an exterior surface of the neck; and a guide element formed about an inner surface of the neck portion;

providing a cap comprising:

a top panel;

a skirt having a thread formed on an inner surface; and one or more drive tabs extending horizontally downwards from a lower surface of the top panel;

providing a cutter attached to and integral with the base, the cutter comprising:

a cylindrical body;

one or more frangible bridges attached between the cylindrical body of the cutter and the neck portion of the base;

a cutting element extending downwards from a lower end of the cylindrical body;

one or more catches extending radially inwards from an inner surface of the cylindrical body configured to interact with the one or more drive tabs to cause rotation of the cutter; and two or more cams extending about an outer surface of the cutter, the cams configured to engage with the guide element of the base to move the cutter from an assembled configuration to a piercing configuration in which the bottommost surface of the cutting element extends below a lowermost portion of the neck portion; and attaching the cap to the base to seal the base by engaging the thread of the cap with the thread of the base, wherein the step of attaching the cap is defined by an initial movement of the cap relative to the base in a purely axial direction and a second subsequent movement of the cap relative to the base in a combined rotational and axial direction;

wherein the downwards movement of the cap relative to the base causes the breakage of the one or more frangible bridges attaching the cutter and the base and also results in the movement of one or both of the cutter and the base relative to one another such that following the attachment of the cap to the base, the cap, the base, and the cutter are arranged in an assembled configuration in which the cutter is positioned radially inwards within the base and the cap is sealingly engaged with the neck portion of the base.

19. The method of claim 18, further comprising attaching the assembled closure to a container along a portion of the mounting portion.

20. The method of claim 19, wherein the movement of one or both of the cutter and the base relative to one another to position the cutter within the base occurs without any rotation of the cutter relative to the base, and involves only movement in an axial direction.

21. The method of claim 20, further comprising the step of unscrewing the cap from the base after the assembled closured has been attached to the container, wherein unscrewing the cap causes a downwards rotational movement of the cutter relative to the base that creates an opening the container.

* * * * *